US007650221B2

(12) United States Patent
Oi et al.

(10) Patent No.: US 7,650,221 B2
(45) Date of Patent: Jan. 19, 2010

(54) EJECTOR SYSTEM FOR VEHICLE

(75) Inventors: Yasuhiro Oi, Susono (JP); Shigemasa Hirooka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/991,958

(22) PCT Filed: May 9, 2007

(86) PCT No.: PCT/IB2007/001198

§ 371 (c)(1),
(2), (4) Date: Mar. 13, 2008

(87) PCT Pub. No.: WO2007/129209

PCT Pub. Date: Nov. 15, 2007

(65) Prior Publication Data

US 2009/0043477 A1 Feb. 12, 2009

(30) Foreign Application Priority Data

May 10, 2006 (JP) ..... 2006-131826
May 18, 2006 (JP) ..... 2006-139416
Jun. 6, 2006 (JP) ..... 2006-157275
Mar. 30, 2007 (JP) ..... 2007-095016

(51) Int. Cl.
*F02D 41/00* (2006.01)

(52) U.S. Cl. ..... 701/103; 123/339.14; 123/585; 701/115

(58) Field of Classification Search ..... 701/103, 701/110, 115; 123/478, 480, 446, 458, 495, 123/674, 339.1, 339.14, 339.17, 339.19, 123/339.22, 339.23, 585, 586
See application file for complete search history.

(56) References Cited

U.S. PATENT DOCUMENTS 4,461,253 A * 7/1984 Kobashi et al. ..... 123/339.23
5,582,148 A * 12/1996 Hashimoto et al. ..... 123/339.22
5,651,342 A * 7/1997 Hara ..... 123/339.24
5,698,780 A * 12/1997 Mizutani et al. ..... 73/114.33
5,711,271 A * 1/1998 Schlagmueller et al. ..... 123/339.24
5,712,786 A * 1/1998 Ueda ..... 701/110
6,092,019 A * 7/2000 Aihara ..... 701/113
6,883,506 B2 * 4/2005 Shin ..... 123/585
6,901,790 B2 * 6/2005 Arai et al. ..... 73/114.32
2003/0205215 A1 11/2003 Hwang et al.

FOREIGN PATENT DOCUMENTS

DE 102 15 204 A1 10/2003
JP A-61-210237 9/1986
JP A-2002-371885 12/2002
JP A-2003-083447 3/2003

(Continued)

*Primary Examiner*—Stephen K Cronin
*Assistant Examiner*—Johnny H Hoang
(74) *Attorney, Agent, or Firm*—Oliff & Berridge, PLC.

(57) ABSTRACT

An ejector system controls the idle speed of an internal combustion engine by controlling an electric throttle valve system that adjusts the flow-rate of the intake air to be supplied to the internal combustion engine, and includes an ejector which generates a negative pressure of which the absolute value is larger than the absolute value of a negative pressure to be introduced from an intake manifold, a vacuum control valve which causes the ejector to operate or causes the ejector to stop operating, and an ECU that controls the vacuum switching valve. With the ejector system, even if the ejector is caused to operate or caused to stop operating, it is possible to appropriately suppress fluctuations in the idle speed, and appropriately obtain a negative pressure.

10 Claims, 13 Drawing Sheets

FOREIGN PATENT DOCUMENTS

| | | |
|---|---|---|
| JP | A-2003-214230 | 7/2003 |
| JP | A 2004-285838 | 10/2004 |
| JP | A 2004-299567 | 10/2004 |
| JP | A 2005-069175 | 3/2005 |
| JP | A-2005-171964 | 6/2005 |
| JP | A 2005-201196 | 7/2005 |
| JP | A-2006-118385 | 5/2006 |
| WO | WO 2005/085616 A1 | 9/2005 |

* cited by examiner

EJECTOR SYSTEM 100A: 1A, 30, 40A

EJECTOR SYSTEM FOR VEHICLE

INCORPORATION BY REFERENCE

The disclosure of Japanese Patent Applications No. 2006-131826 filed on May 10, 2006, No. 2006-139416 filed on May 18, 2006, No. 2006-157275 filed on Jun. 6, 2007 and No. 2007-095016 filed on Mar. 30, 2007 including the specification, drawings and abstract is incorporated herein by reference in its entirety.

BACKGROUND OF THE INVENTION

1. Field of the Invention

The invention relates generally to an idle-speed control unit and an ejector system for a vehicle. More specifically, the invention relates to an idle-speed control unit and an ejector system for a vehicle, which appropriately suppress fluctuations in the idle speed even if the ejector is caused to operate or caused to stop operating.

2. Description of the Related Art

Conventionally, an ejector is used to supply a brake booster with a negative pressure of which the absolute value is larger than the absolute value of a negative pressure to be introduced from an intake passage of an intake system of an internal combustion engine, which provides communication between the atmosphere and each cylinder (hereinafter, simply referred to as an "intake system of an internal combustion engine" where appropriate). The ejector is usually arranged in a bypass passage that allows the intake air to bypass a throttle valve, and generates a negative pressure having a large absolute value with Venturi effect. Such ejector is described in the following publications. Japanese Patent Application Publication No. JP-2005-69175 (JP-A-2005-69175) describes a control apparatus for a vehicle, which includes a correction device that corrects the flow-rate at which the air to be taken in an internal combustion engine flows (hereinafter, sometimes referred to as the "intake air flow-rate") based on the operating state of an ejector. Also, there is proposed a technology in which an ejector is arranged together with an idle-speed control valve in an idle duct, which allows the intake air to bypass a throttle valve, to form a negative pressure generator.

Japanese Patent Application Publication No. 2004-299567 (JP-A-2004-299567) describes a negative pressure generator that has the structure in which an ejector and an idle-speed control valve are combined with each other. Japanese Patent Application Publication No. 2005-201196 (JP-A-2005-201196) describes a negative pressure supply device for a vehicle formed by arranging a throttle valve for an ejector, which is fitted to a support shaft that rotates together with the throttle valve, in a bypass passage in which an ejector is provided.

When an internal combustion engine is idling, the idle-speed control is usually executed. In the idle-speed control, a flow-rate adjustment device such as an idle-speed control valve or a throttle valve is controlled to control the idle speed. FIG. 15 is the view conceptually showing the common idle-speed control. The idle-speed control usually includes the feedback control for controlling the flow-rate adjustment device so that fluctuations in the idle speed of the internal combustion engine are suppressed; the learning control for controlling the flow-rate adjustment device based on the results of the feedback control so that the idle speed is maintained at the target speed; and the correction control for controlling the flow-rate adjustment device so that the target speed is changed based on the operating state of, for example, an air-conditioner. Under the idle-speed control, the intake air flow-rate is adjusted to the required intake air flow-rate, which is required to operate the internal combustion engine at the target speed, by executing the controls described above. Accordingly, as shown in FIG. 15, when the ejector is caused to operate while the internal combustion engine is idling, the intake air flow-rate increases. At the same time, the intake air flow-rate is decreased by the feedback control to suppress fluctuations in the idle speed. In the feedback control executed at this time, the control amount to be achieved by the feedback control (hereinafter, sometimes referred to as the "feedback control amount") is decreased by the correction amount corresponding to an increase in the intake air flow-rate (hereinafter, sometimes referred to as the "feedback correction amount").

FIG. 13 is the graph schematically showing a change that occurs in the flow-rate of the intake air flowing through a bypass passage when an ejector is caused to operate. The cross-section of a passage formed within the ejector is gradually decreased toward the portion at which a negative pressure is generated with venturi effect. Accordingly, when the ejector is caused to operate, the intake air flow-rate increases not instantaneously but gradually. As a result, a time lag is caused between when the ejector is caused to operate and when the intake air flow-rate reaches the final value. However, Japanese Patent Application Publication No. 2005-69175 (JP-A-2005-69175) does not describe the manner in which the intake air flow-rate increases. Accordingly, it is considered that the intake air flow-rate is decreased uniformly through correction when the ejector is caused to operate, in the control apparatus for a vehicle described in JP-A-2005-69175. Namely, with the control apparatus for a vehicle described in JP-A-2005-69175, although fluctuations in the intake air flow-rate are ultimately suppressed, the intake air flow-rate may be temporarily decreased if the correction is made at an inappropriate time when the intake air flow-rate is transiently changing.

When the intake air flow-rate is transiently changing, controlling the air-fuel ratio accurately is likely to be difficult due to the delayed response to the detection of the intake air flow-rate. In contrast, with the control apparatus for a vehicle according to JP-A-2005-69175, even if the ejector is caused to operate or caused to stop operating when the engine is idling, for example, the detected intake air flow-rate is corrected so as to coincide with the intake air flow-rate that is actually increasing or decreasing. Accordingly, the inconvenience caused by the delayed response to the detection of the intake air flow-rate is minimized. As a result, the air-fuel ratio is controlled more accurately.

Meanwhile, the feedback control in the idle-speed control described above is usually executed based on the difference between the required intake air flow-rate and the detected intake air flow-rate. For example, if the detected intake air flow-rate is corrected by the control apparatus for a vehicle described in JP-A-2005-69175, the idle-speed control is more appropriately executed even if the ejector is caused to operate or caused to stop operating, because the inconvenience caused by the delayed response to the detection of the intake air flow-rate is minimized. However, the feedback control is executed in the idle-speed control. Accordingly, if the intake air flow-rate is corrected in a certain manner, the idle speed may fluctuate due to the feedback control if the ejector is caused to operate or caused to stop operating. In this case, such fluctuations may give a sense of discomfort to the driver.

As shown in FIG. 15, in the learning control, the control amount to be achieved by the learning control (hereinafter, sometimes referred to as the "learning control amount") is decreased or increased by an amount corresponding to an increase or a decrease in the feedback control amount (hereinafter, sometimes referred to as "learning is executed"). At the same time, the feedback control amount is increased or decreased by an amount corresponding to a decrease or an increase in the learning control amount. However, when the intake air flow-rate is transiently changing, the learning is not always properly executed as intended. Therefore, if the learning is executed even when the ejector is caused to operate, the learning control amount may be considerably small. In this case, when the ejector is caused to stop operating, the intake air flow-rate considerably decreases, and the idle speed also considerably decreases. In addition, the intake air flow-rate becomes severely deficient. In some cases, the feedback control fails to be executed in time, and therefore engine stalling may occur.

In a negative pressure generator described in each of Japanese Patent Application Publication No. 2004-285838 (JP-A-2004-285838) and Japanese Patent Application Publication No. 2004-299567 (JP-A-2004-299567), an ejector is structured to generate a negative pressure in accordance with the intake air flow-rate adjusted by an idle-speed control valve. Accordingly, if a negative pressure having a large absolute value needs to be generated by the ejector, the idle speed inevitably excessively increases due to the structure. In this case, because a negative pressure to be introduced from an intake system of an internal combustion engine is decreased, a negative pressure generated by the ejector is decreased by an amount corresponding to a decrease in the negative pressure to be introduced from the intake system. Namely, due to the structure of the negative pressure generator described above, the ejector is not efficiently used when the absolute value of the negative pressure to be introduced from the intake system of the internal combustion engine is large. In the negative pressure supply device described in JP-A-2005-201196, the throttle valve and the throttle valve for an ejector cannot be controlled independently of each other. Accordingly, it is considered that the ejector is not efficiently used when the absolute value of the negative pressure to be introduced from the internal combustion engine is large. Meanwhile, the amount of negative pressure supplied by the ejector per unit time is not considerably large. Accordingly, a required negative pressure may not be obtained in time.

SUMMARY OF THE INVENTION

The invention is made in light of the above-described circumstances. The invention, therefore, provides an ejector system for a vehicle that appropriately suppresses fluctuations in the idle speed of an internal combustion engine and that appropriately obtains a negative pressure, even if an ejector is caused to operate or is caused to stop operating.

An aspect of the invention relates to an ejector system for a vehicle that includes a flow-rate adjustment device that adjusts the intake air flow-rate that is the flow-rate of the intake air to be supplied to an internal combustion engine; an ejector that generates a negative pressure of which the absolute value is larger than the absolute value of a negative pressure to be introduced from an intake passage of an intake system of the internal combustion engine; a state changing device that causes the ejector to operate or causes the ejector to stop operating; and a control unit that controls the state changing device, and that controls the flow-rate adjustment device based on the operating state of the ejector.

With the ejector system for a vehicle described above, fluctuations in the intake air flow-rate are suppressed, because the intake air flow-rate is adjusted in accordance with a change in the operating state of the ejector. Accordingly, it is possible to appropriately suppress fluctuations in the idle speed of the internal combustion engine.

In the ejector system for a vehicle described above, the control unit may further include an idle-speed control amount correction device that corrects the idle-speed control amount used in the idle-speed control executed on the flow-rate changing device by the ejector correction amount appropriate for the intake air flow-rate that increases or decreases in accordance with the operating state of the state changing device.

With the ejector system for a vehicle described above, fluctuations in the intake air flow-rate, which are inevitable in the feedback control in which the correction is made based on the already-changed operating state, are suppressed by correcting the idle-speed control amount by the ejector correction amount at an appropriate time in accordance with a change in the operating state of the state changing device. Thus, fluctuations in the idle speed are appropriately suppressed. The description "the ejector correction amount appropriate for the intake air flow-rate that increases or decreases in accordance with a change in the operating state of the state changing device" means that the ejector correction amount does not correspond to the intake air flow-rate in the already-changed operating state.

In the ejector system for a vehicle described above, the control unit may further include a specific control amount learning device that learns the control amount used to control the flow-rate adjustment device so that, when the intake air flow-rate deviates from the target intake air flow-rate by an amount equal to or greater than the predetermined value due to a change in the operating state of the state changing device, if a new change is caused in the operating state of the state changing device, the intake air flow-rate is maintained at the target intake air flow-rate or the intake air flow-rate falls within the allowable fluctuation range with respect to the target intake air flow-rate.

The intake air flow-rate that increases or decreases in accordance with the operating state of the state changing device (hereinafter, simply referred to as the "ejector flow-rate" where appropriate) varies with each ejector system for a vehicle due to production errors in the ejectors. Therefore, the variation in the ejector flow-rate may be checked, and the ejector correction amount may be set, for example, to a value corresponding to the median value of the variation. However, even when such variation is within the production tolerance range, if the actual ejector flow-rate deviates from the median value, the idle speed somewhat fluctuates. As the deviation of the ejector flow-rate from the median value increases, the fluctuation in the idle speed becomes larger. Also, the ejector flow-rate may decrease due, for example, to the temporal change caused by accumulating deposits in an inner passage of the ejector and a bypass passage in which the ejector is arranged. In such a case, the actual ejector flow-rate may deviate from the median value by a larger amount.

In contrast, with the ejector system for a vehicle described above, the learning of the control amount is executed only when the intake air flow-rate deviates from the target intake air flow-rate by an amount equal to or larger than the predetermined value when the state changing device is controlled to cause the ejector to operate. Accordingly, it is possible to promptly suppress fluctuations in the idle speed within the predetermined allowable range. It is, therefore, possible to more appropriately suppress fluctuations in the idle speed.

In the aspect of the invention, the learning of the control amount may be executed by increasing or decreasing the ejector correction amount by an increase or a decrease in the feedback control amount. Therefore, the control amount used to control the flow-rate adjustment device according to the aspect of the invention signifies the ejector correction amount. Thus, when the control amount is the learning control amount, it is possible to minimize the possibility that the learning of the control amount is not executed appropriately due to the restriction on the learning control (e.g. the learning control amount) executed generally in the idle-speed control. At this time, execution of the learning of the learning control amount may be prohibited when the ejector is operating in order to avoid a conflict between the controls. More specifically, the specific learning control device may learn the control amount during the period from when the intake air flow-rate is made substantially equal to the target intake air flow-rate by the feedback control at least until when deviation of the intake air flow-rate from the target intake air flow-rate occurs (for example, until when the operating state of the state changing device further changes). Thus, it is possible to prevent or minimize the possibility that the learning is not executed properly as a result of execution of the learning when the intake air flow-rate is transiently changing.

In the ejector system for a vehicle described above, the control unit may further include an ejector correction amount changing device that changes the ejector correction amount in accordance with the difference between the pressure on the side of an inlet port of the ejector and the pressure on the side of an outlet port of the ejector.

The ejector flow-rate changes in accordance with the pressure difference described above (hereinafter, simply referred to as the "ejector upstream-downstream pressure difference"), as shown in FIG. 16. Accordingly, to appropriately suppress fluctuations in the idle speed, the ejector correction amount may be changed based on the ejector upstream-downstream pressure difference. This can be realized by the ejector system described above. The ejector correction amount may be changed based, for example, on the ejector upstream-downstream pressure difference itself. However, the ejector correction amount may be changed based on a parameter that is detected or estimated more easily than the ejector upstream-downstream pressure difference. For example, the ejector correction amount may be changed based on the engine speed and the intake air flow-rate that are closely correlated with the ejector upstream-downstream pressure difference or the negative pressure to be introduced from the intake passage.

In the ejector system for a vehicle described above, the control unit may further include a control amount learning device that learns the learning control amount used in the learning control executed on the flow-rate adjustment device so that the intake air flow-rate is maintained at the target intake air flow-rate; and a control amount learning prohibition device that prohibits execution of the learning when the ejector is operating.

With the ejector system for a vehicle described above, because execution of the learning is prohibited when the ejector is operating, it is possible to suppress large fluctuations in the idle speed due to execution of the learning when the intake air flow-rate is transiently changing.

In the ejector system for a vehicle described above, the control unit may further include a feedback control device that controls the flow-rate adjustment device in a feedback manner so that fluctuations in the intake air flow-rate are suppressed; and a control speed changing device that increases the control speed at which the feedback control device controls the intake air flow-rate adjustment device in a feedback manner, in accordance with a change in the operating state of the state changing device.

With the ejector system for a vehicle described above, it is possible to moderate the fluctuations in the intake air flow-rate rapidly. As a result, it is possible to stabilize the idle speed even if the ejector is caused to operate or caused to stop operating. When the intake air flow-rate is transiently changing, the control speed may be changed as rapidly as possible to prevent occurrence of hunting. For example, the control speed may be changed rapidly only during a predetermined period in accordance with a change in the operating state of the state changing device.

In the ejector system for a vehicle described above, the state changing device may be structured to variably control the flow passage area of a passage, and the control unit may further include a gradual change control device that gradually controls the state changing device so that the flow passage area of the passage is gradually increased or decreased at a predetermined rate.

With the ejector system for a vehicle described above, it is possible to suppress abrupt fluctuations in the intake air flow-rate even when the ejector is caused to operate or caused to stop operating. Thus, even if a delayed response to the detection of the transiently changing intake air flow-rate is given, the feedback control in the idle-speed control is easily executed using the intake air flow-rate that accurately coincides with the actual intake air flow-rate. Accordingly, it is possible to suppress large fluctuations in the idle speed. With the ejector system for a vehicle described above, because the abrupt fluctuations in the intake air flow-rate are suppressed, it is also possible to suppress occurrence of torque shock in the internal combustion engine regardless of whether the internal combustion engine is idling.

In the ejector system for a vehicle described above, the control unit may further include a response correction control amount calculation device that calculates the response correction control amount used to control the flow-rate adjustment device so that the intake air flow-rate increases when the state changing device is controlled to cause the ejector to operate.

With the ejector system for a vehicle described above, the intake air flow-rate is rapidly increased by the intake air flow-rate adjustment device when the ejector is caused to operate. Namely, it is possible to correct the delayed response to the detection of the intake air flow-rate that gradually increases when the ejector is caused to operate. Thus, a gradual increase in the intake air flow-rate that is caused when the ejector is caused to operate is regarded as an instantaneous increase in the intake air flow-rate. Accordingly, it becomes easier to execute the idle-speed control at an appropriate time using, for example, the ejector as the target of the correction control included in the idle-speed control. As a result, fluctuations in the idle speed are more appropriately suppressed. If the ejector is used as the target of the correction control included in the idle-speed control, it is possible to appropriately suppress fluctuations in the idle speed due to execution of the feedback control. With the ejector system for a vehicle described above, not only when the internal combustion engine is idling but also, for example, when the ejector is caused to operate while the vehicle is accelerating, a gradual change in the intake air flow-rate is regarded as an instantaneous change in the intake air flow-rate. As a result, it becomes easier to correct the fuel injection amount at an appropriate time, and to appropriately execute the air-fuel ratio control.

In the ejector system for a vehicle described above, the response correction control amount calculation device may change the response correction control amount so that the intake air flow-rate gradually decreases.

With the ejector system for a vehicle described above, even if the flow-rate of the intake air that actually flows through the bypass passage after the ejector is caused to operate, it is possible to continuously regard a gradual increase in the intake air flow-rate.

In the ejector system for a vehicle described above, the flow-rate adjustment device may include an idling-time flow-rate adjustment device that adjusts the intake air flow-rate when the internal combustion engine is idling, and the ejector may be arranged in a passage that differs from the passage in which the idling-time flow-rate adjustment device is arranged.

With the ejector system for a vehicle described above, because the negative pressure generator is arranged in the passage that differs from the passage in which the idle-speed adjustment device is arranged and the negative pressure generator is controlled independently of the idle-speed adjustment device, a negative pressure is obtained using the ejector even if the idle speed is low, namely, even if a negative pressure to be introduced from the intake system of the internal combustion engine is high.

In the ejector system for a vehicle described above, the control unit may further include a priority control device that gives a higher priority to controlling of the state changing device than controlling of the idling-time flow-rate adjustment device, when the intake air flow-rate is adjusted to the intake air flow-rate required by the internal combustion engine while the internal combustion engine is idling.

In the ejector system for a vehicle described above, a higher priority is given to controlling of the state changing device than controlling of the idle-speed adjustment device. Accordingly, it is possible to cause the ejector to constantly operate by employing the configuration described above and implementing the state changing device by a flow-rate adjustment valve that controls the flow passage area of the passage. Therefore, with the ejector system for a vehicle described above, it is possible to minimize the inconvenience that is caused when the ejector is caused to operate as needed and that is caused by a delay in response to a change in the intake air flow-rate during the transitional period when a negative pressure is obtained.

In the ejector system for a vehicle described above, the priority control device may control the state changing device so that the ejector is caused to operate, when the intake air flow-rate required by the internal combustion engine is greater than the intake air flow-rate that increases when the state changing device is controlled.

When the state changing device is a valve that is structured to switch the flow passage area of the passage between the fully-open flow passage area and the fully-closed flow passage area, if the valve is fully opened when the target value for the idle speed is low, the intake air flow-rate may be excessively larger than the intake air flow-rate required by the internal combustion engine and the idle speed may be excessively high. In contrast, with the ejector system for a vehicle described above, it is possible to cause the ejector to operate more frequently without affecting maintenance of the idle speed. Thus, a negative pressure is obtained in advance. Accordingly, it is possible to minimize the inconvenience that is caused when the ejector is caused to operate as needed and that is caused by a delay in response to a change in the intake air flow-rate during the transitional period when a negative pressure is obtained.

In the ejector system for a vehicle described above, the intake air flow-rate required by the internal combustion engine may be an intake air flow-rate that is indicated by a predetermined control amount which need not be responsive to a change in the intake air flow-rate, from among control amounts used to control the idling-time flow-rate adjustment device.

The cross-section of the passage formed within the ejector is gradually decreased toward the portion at which a negative pressure is generated. Accordingly, the intake air flow-rate gradually increases when the ejector is caused to operate. Namely, the intake air flowing through the ejector does not promptly respond to an increase in the intake air flow-rate. Based on this, the intake air flow-rate that is indicated by the control amount which needs to be responsive to a change in the intake air flow-rate, more specifically, the control amount used in the feedback control executed to suppress fluctuations in the idle speed may be adjusted by the idle-speed adjustment device that promptly deals with a change in the intake air flow-rate to appropriately control the idle speed. With the ejector system for a vehicle described above, it is possible to cause the ejector to operate more frequently without affecting the maintenance of the idle speed. Thus, a negative pressure is obtained in advance. Accordingly, it is possible to minimize the inconvenience that is caused when the ejector is caused to operate as needed and that is caused by a delay in response to a change in the intake air flow-rate during the transitional period when a negative pressure is obtained.

The invention provides the ejector system for a vehicle that executes the idle-speed control for appropriately suppressing fluctuations in the idle speed of the internal combustion engine even if the ejector is caused to operate or caused to stop operating, and the appropriate air-fuel ratio control, and that appropriately obtains a negative pressure.

BRIEF DESCRIPTION OF THE DRAWINGS

The features, advantages thereof, and technical and industrial significance of this invention will be better understood by reading the following detailed description of example embodiments of the invention, when considered in connection with the accompanying drawings, in which.

DETAILED DESCRIPTION OF THE EXAMPLE EMBODIMENTS

In the following description and the accompanying drawings, the present invention will be described in more detail with reference to example embodiments.

Figure 1:
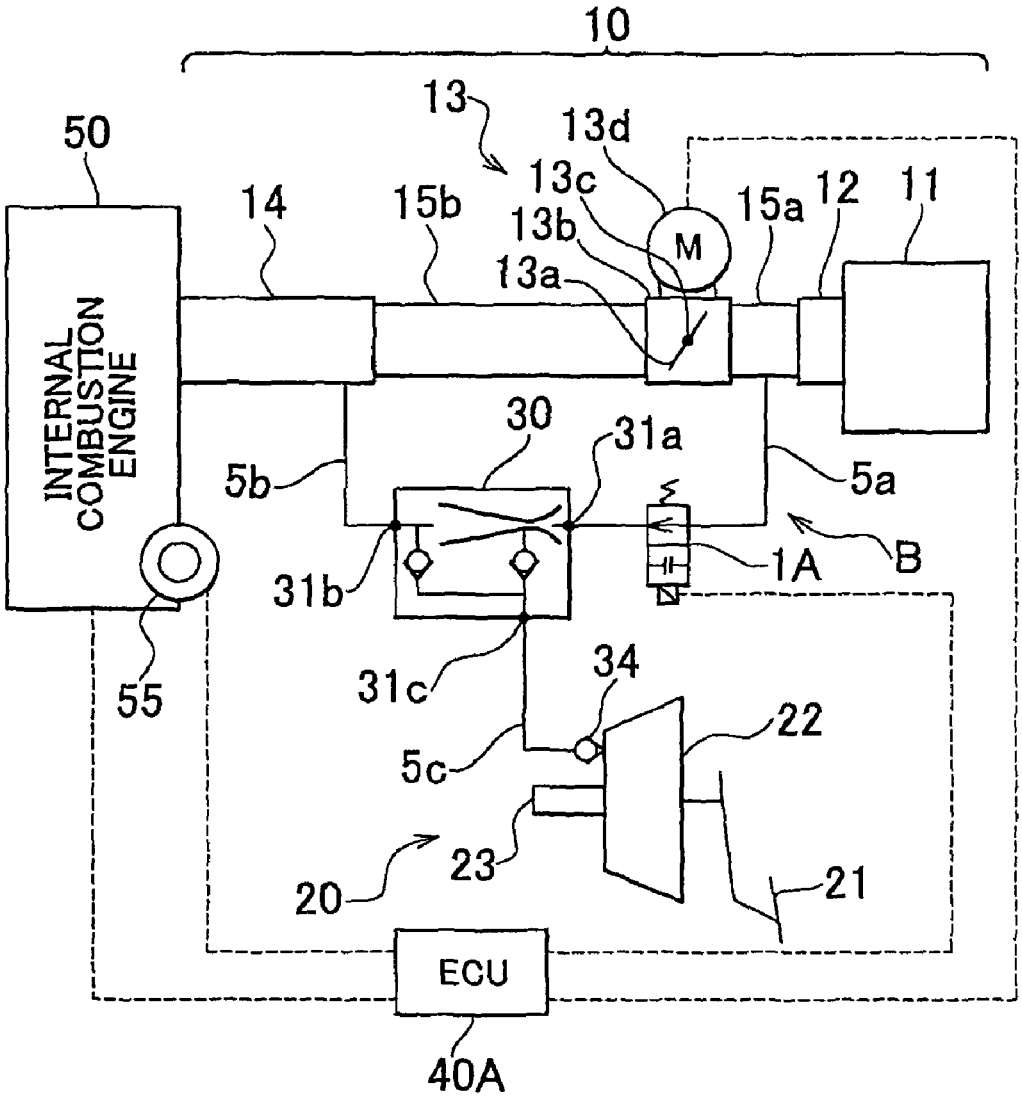
FIG. 1 is the view schematically showing an ejector system 100A according to a first embodiment of the invention.

Hereafter, a first embodiment of the invention will be described. FIG. 1 shows an idle-speed control unit according to the first embodiment of the invention, which is implemented by an ECU (electronic control unit) 40A, together with an ejector system for a vehicle (hereinafter, simply referred to as an "ejector system") 100A. The components shown in FIG. 1, for example, an internal combustion engine 50, are mounted in a vehicle (not shown). An intake system 10 of the internal combustion engine 50 includes an air cleaner 11, air-flow meter 12, an electric throttle valve system 13, an intake manifold 14, an intake port that communicates with each cylinder (not shown) of the internal combustion engine 50, pipes that are provided between these components, for example, intake pipes 15*a* and 15*b*, etc. The air cleaner 11 is used to filter the intake air that is supplied to each cylinder of the internal combustion engine 50, and is communicated with the atmosphere via an air duct (not shown). The airflow meter 12 is used to detect the intake air flow-rate, and outputs a signal indicating the detected intake air flow-rate.

The electric throttle valve system 13 includes a throttle valve 13*a*, a throttle body 13*b*, a valve stem 13*c*, and an electric motor 13*d*. The opening amount of throttle valve 13*a* is changed to adjust the flow-rate of the entire intake air to be supplied to the cylinders of the internal combustion engine 50. Any types of internal combustion engines may be used as the internal combustion engine 50, as long as the intake air flow-rate is adjusted by a throttle valve such as the throttle valve 13*a* according to the first embodiment of the invention. According to the first embodiment of the invention, the electric throttle valve system 13 is used to adjust the intake air flow-rate to control the idle speed of the internal combustion engine 50. The electric throttle valve system 13 according to the first embodiment of the invention functions as a flow-rate adjustment device. The throttle body 13*b* is formed of a cylindrical member in which an intake passage is formed. The throttle body 13*b* supports the valve stem 13*c* of the throttle valve 13*a* provided in the intake passage. The electric motor 13*d* is used to change the opening amount of throttle valve 13*a* under the control executed by the ECU 40A. A step motor is used as the electric motor 13*d*. The electric motor 13*d* is fitted to the throttle body 13*b*. An output shaft (not shown) of the electric motor 13*d* is coupled with the valve stem 13*c*. The opening amount of throttle valve 13*a* is detected by the ECU 40A based on the signal output from an encoder (not shown) embedded in the electric throttle valve system 13.

The technology called throttle-by-wire for driving throttle valves such as the throttle valve 13*a* of the electric throttle valve system 13 using an actuator is preferably employed in a throttle valve system. Alternatively, a mechanical throttle valve system that operates in accordance with an accelerator pedal (not shown) via, for example, a wire to change the opening amount of throttle valve 13*a* may be employed, instead of the electric throttle valve system 13. In this case, for example, a bypass passage that allows the intake air to bypass the throttle valve 13*a* may be formed, and a so-called idle-speed control valve that adjusts the flow passage area of the bypass passage may be provided, as the flow-rate adjustment device, in the bypass passage, whereby the idle speed of the internal combustion engine 50 is controlled. Accordingly, the idle-speed control valve may be used as the flow-rate adjustment device according to the invention. The intake manifold 14 is used to branch the intake passage, of which the upstream-side portion is formed of a single piece, off into multiple portions connected to the respective cylinders of the internal combustion engine 50. The intake manifold 14 distributes the intake air to these cylinders.

A brake unit 20 includes a brake pedal 21, a brake booster 22, a master cylinder 23, and wheel cylinders (not shown). The brake pedal 21, which is operated by a driver to reduce the rotational speed of wheels, is coupled with an input rod (not shown) of the brake booster 22. The brake booster 22 is used to generate an assisting force that corresponds to a value obtained by multiplying the pedal depressing force by a predetermined number. A negative pressure chamber (not shown), formed on the master cylinder 23 side in the brake booster 22, is connected to the intake passage of the intake manifold 14 via an ejector 30. An output rod (not shown) of the brake booster 22 is coupled with an input shaft (not shown) of the master cylinder 23. The master cylinder 23 generates a hydraulic pressure in accordance with an acting force from the brake booster 22, which is obtained by adding the assisting force to the brake pedal depressing force. The master cylinder 23 is connected to the wheel cylinders of disc brake mechanisms (not shown) of the wheels via a hydraulic circuit. Bach wheel cylinder generates a braking force using the hydraulic pressure supplied from the master cylinder 23. Any types of pneumatic brake boosters may be used as the brake booster 22.

The ejector 30 generates a negative pressure of which the absolute value is larger than the absolute value of a negative pressure to be introduced from the intake system 10, more specifically, a negative pressure to be introduced from the intake manifold 14, and supplies the negative pressure having the large absolute value to the negative pressure chamber of the brake booster 22. The ejector 30 has an inlet port 31*a*, an outlet port 31*b*, and a negative pressure supply port 31*c*. The negative pressure supply port 31*c* is connected to the negative pressure chamber of the brake booster 22 via an air hose 5*c*. The inlet port 31*a* is connected to the intake passage formed within the intake pipe 15*a* via an air hose 5*a*, and the outlet port 31*b* is connected to the intake passage formed within the intake manifold 14 via an air hose 5*b* such that the electric throttle valve system 13, more specifically, the throttle valve 13*a* is located between the points at which the air hoses 5*a* and 5*b* are connected to the intake passage. Thus, a bypass passage B that allows the intake air to bypass the electric throttle valve system 13 is formed of the ejector 30, the air hoses 5*a* and 5*b*. When the ejector is not operating, a negative pressure is supplied to the negative pressure chamber of the brake booster 22 from the intake passage formed within the intake manifold 14 via the air hose 5*b*, the outlet port 31*b* and the negative pressure supply port 31*c* of the ejector 30, and the air hose 5*c*.

The air hose 5*a* is provided with a vacuum switching valve 1A. The vacuum switching valve 1A permits/blocks communication through the bypass passage B under the control executed by the ECU 40A. According to the first embodiment of the invention, a two-position two-port normally-closed solenoid valve is used as the vacuum switching valve 1A. Alternatively, the vacuum switching valve 1A may be another type of electromagnetically-driven valve. Also, the vacuum switching valve 1A may be a flow-rate adjustment valve that controls the flow passage area of the passage. The vacuum switching valve 1A permits/blocks the communication through the bypass passage B, thereby causing the ejector 30 to operate/causing the ejector 30 to stop operating. According to the first embodiment of the invention, the vacuum switching valve 1A functions as a state changing device.

Figure 2:
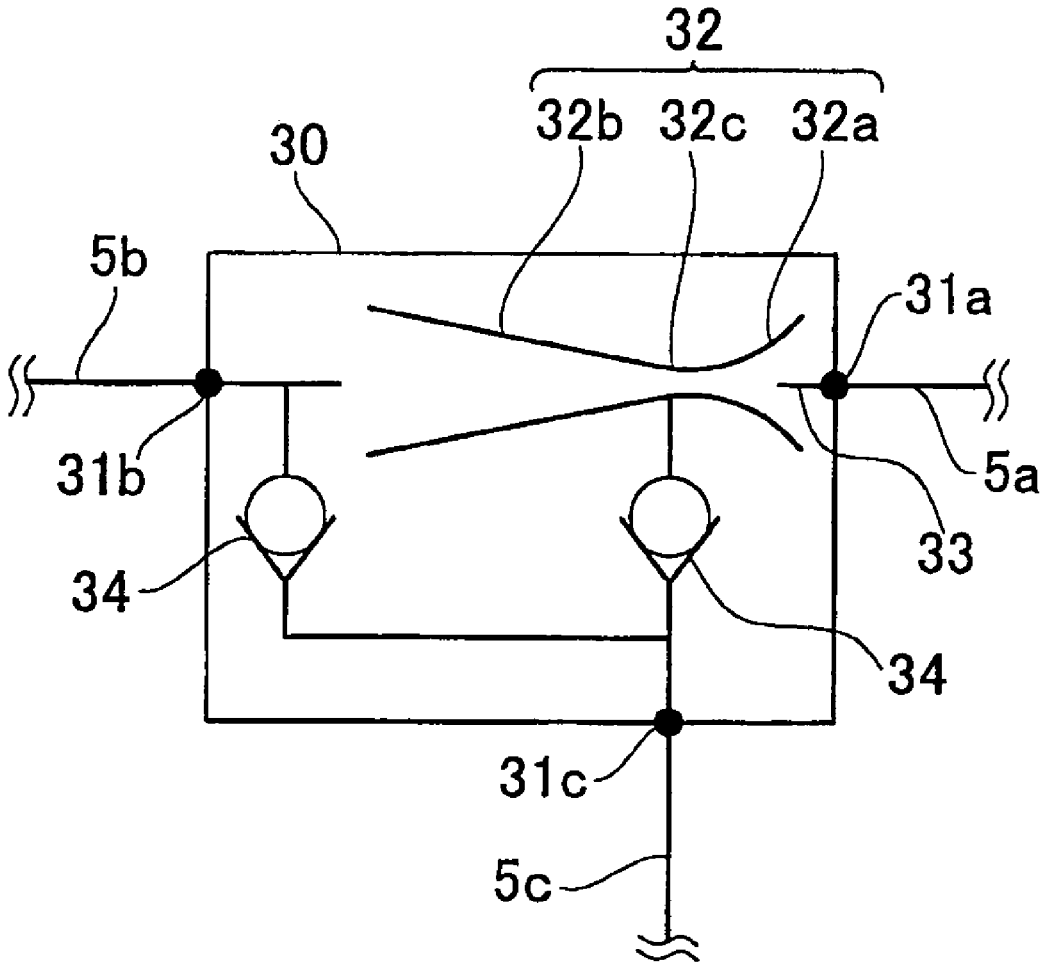
FIG. 2 is the view schematically showing the inner structure of an ejector 30 according to the first embodiment of the invention.

FIG. 2 schematically shows the inner structure of the ejector 30. A diffuser 32 is provided inside the ejector 30. The diffuser 32 includes a first tapered portion 32*a*, a second tapered portion 32*b* and a negative pressure generation portion 32*c* that is a passage which provides communication between these tapered portions 32*a* and 32*b*. The first tapered portion 32*a* is open toward the inlet port 31*a*, and the second tapered portion 32*b* is open toward the outlet port 31*b*. The negative pressure generation portion 32*c* is communicated with the negative pressure supply port 31*c*. A nozzle 33, which injects the intake air toward the first tapered portion 32*a*, is provided at the inlet port 31*a*. The intake air injected from the nozzle 33 flows through the diffuser 32, and flows to the air hose 5*b* through the outlet port 31*b*. At this time, a high-speed jet flow is generated in the diffuser 32. Thus, a negative pressure having a large absolute value is generated in the negative pressure generation portion 32*c* with venturi effect, and the negative pressure having the large absolute value is supplied from the negative pressure supply port 31*c* to the negative pressure chamber through the air hose 5*c*. Due to the function of the ejector 30, the brake booster 22 obtains a negative pressure of which the absolute value is larger than the absolute value of a negative pressure introduced from the intake manifold 14. Check valves 34 that prevent back-flows are provided in an inner passage formed between the negative pressure generation portion 32*c* and the negative pressure supply port 31*c*, in an inner passage formed between the outlet port 31*b* and the negative pressure supply port 31*c*, and at a position at which the brake booster 22 is connected to the air hose 5*c*. The ejector 30 is not limited to the ejector having the inner structure shown in FIG. 2. An ejector having another inner structure may be used instead of the ejector 30.

The internal combustion engine 50 is provided with an air-conditioner compressor 55. A pulley of a drive shaft of the air-conditioner compressor 55 is connected to a pulley of an output shaft of the internal combustion engine 50 via a belt. In addition to the pulley of the air-conditioner compressor 55, pulleys of other auxiliaries such as a pulley of a pump for power steering, and a pulley of a generator are connected, via belts, to the pulley of the output shaft of the internal combustion engine 50. A drive shaft of the air-conditioner compressor 55 is provided with an electromagnetically-controlled clutch (not shown). The electromagnetically-controlled clutch is engaged/disengaged by turning on/off an air-conditioner switch SW (not shown) under the control executed by the ECU 40. Thus, the air-conditioner compressor 55 for an air-conditioner is driven or stopped.

The ECU 40A includes a CPU (Central Processing Unit), ROM (Read Only Memory), RAM (Random Access Memory), an input circuit, an output circuit, etc. The ECU 40A controls mainly the internal combustion engine 50. According to the first embodiment of the invention, the ECU 40A controls also the electric throttle valve system 13 and vacuum switching valve 1A. In addition to the electric throttle valve system 13 and the vacuum switching valve 1A, various control-target components are connected to the ECU 40A via a drive circuit (not shown). Also, various sensors and components such as an encoder, an accelerator pedal operation amount sensor (not shown) that detects the operation amount of an accelerator pedal, a crank angle sensor (not shown) that detects the engine speed Ne of the internal combustion engine 50, and the air-conditioner switch SW are connected to the ECU 40A. According to the first embodiment of the invention, the idle-speed control unit and the control unit for the ejector system 100A are implemented by the ECU 40A.

The ROM stores programs in which various processes executed by the CPU are written. According to the first embodiment of the invention, the ROM stores the vacuum switching valve 1A control program used to control the vacuum switching valve 1A to cause the ejector 30 to operate or cause the ejector 30 to stop operating under various conditions, and the idle-speed control program used to control the electric throttle valve system 13 to control the idle speed, etc. in addition to the program used to control the internal combustion engine 50. These programs may be combined with each other. The idle-speed control program includes the feedback control amount changing program, the control amount learning program, the correction control amount increase/decrease program, the idle-speed control amount calculation program, and the electric throttle valve system control program. According to the feedback control amount changing program, the feedback control amount is changed based on the difference between the target intake air flow-rate and the intake air flow-rate detected based on the signal output from the airflow meter 12 to control the electric throttle valve system 13 in a feedback manner (hereinafter, sometimes referred to as "the feedback control is executed on the electric throttle valve system 13") such that fluctuations in the intake air flow-rate are suppressed. According to the control amount learning program, the learning control amount is learned to execute the learning control on the electric throttle valve system 13 based on the results of the feedback control such that the intake air flow-rate is maintained at the target intake air flow-rate. According to the correction control amount increase/decrease program, the correction control amount used in the correction control executed on the electric throttle valve system 13 is increased or decreased such that the target speed for the internal combustion engine 50 is changed based on the operating state of, for example, the air-conditioner. According to the idle-speed control amount calculation program, the idle-speed control amount used to control the electric throttle valve system 13 is finally calculated based on the feedback control amount, the learning control amount and the correction control amount. According to the electric throttle valve system control program, the electric throttle valve system 13 is controlled based on the calculated idle-speed control amount.

According to the first embodiment of the invention, the idle-speed control amount calculation program includes the idle-speed control amount correction program. According to the idle-speed control amount correction program, the idle-speed control amount used to control the electric throttle valve system 13 is corrected, based on the operating state of the vacuum switching valve 1A, by the ejector correction amount appropriate for the intake air flow-rate that increases/decreases in accordance with a change in the operating state of the vacuum switching valve 1A. The ejector correction amount is calculated based on the estimated intake air flow-rate appropriate for the intake air flow-rate that increases/decreases in accordance with a change in the operating state of the vacuum switching valve 1A. According to the first embodiment of the invention, the correction control amount increase/decrease program includes the ejector correction amount calculation program. According to the ejector correction amount calculation program, the ejector correction amount is calculated based on the operating state of the vacuum switching valve 1A. The ejector correction amount is regarded as one of the correction control amounts used in the idle-speed control and calculated as one of the correction control amounts. The estimated intake air flow-rate is set in advance based on the results of measurements such as a bench test, and stored in the ROM. Preferably, the estimated intake air flow-rate is defined by map data based on the operating state of the internal combustion engine 50, for example, the engine speed Ne and the throttle valve opening amount. Instead of the estimated intake air flow-rate, the ejector correction amount may be directly stored in the ROM. An idle-speed control amount correction device is implemented by the CPU, the ROM, the RAM (hereinafter, collectively referred to as the CPU, etc. where appropriate), and the idle-speed control amount correction program according to the first embodiment of the invention.

The idle-speed control device is implemented by the CPU, etc. and the idle-speed control program. The idle-speed control device is formed by combining a feedback control device, a learning control device and a correction control device together based on the control amount calculation program. According to the first embodiment of the invention, the feedback control device is implemented by the CPU, etc. the feedback control amount changing program and the electric throttle valve system control program. The learning control device is implemented by the CPU, etc., the control amount learning program and the electric throttle valve system control program. The correction control device is implemented by the CPU, etc., the correction amount increase/decrease program, and the electric throttle valve system control program. Each of the feedback control device, the learning control device and the correction control device is implemented as a part of the idle-speed control device. A control amount learning device is implemented by the CPU, etc., and the control amount learning program, as a part of the learning control device. According to the first embodiment of the invention, the ejector system 100A is implemented by the vacuum switching valve 1A, the ejector 30, and the ECU 40A.

Figure 3:
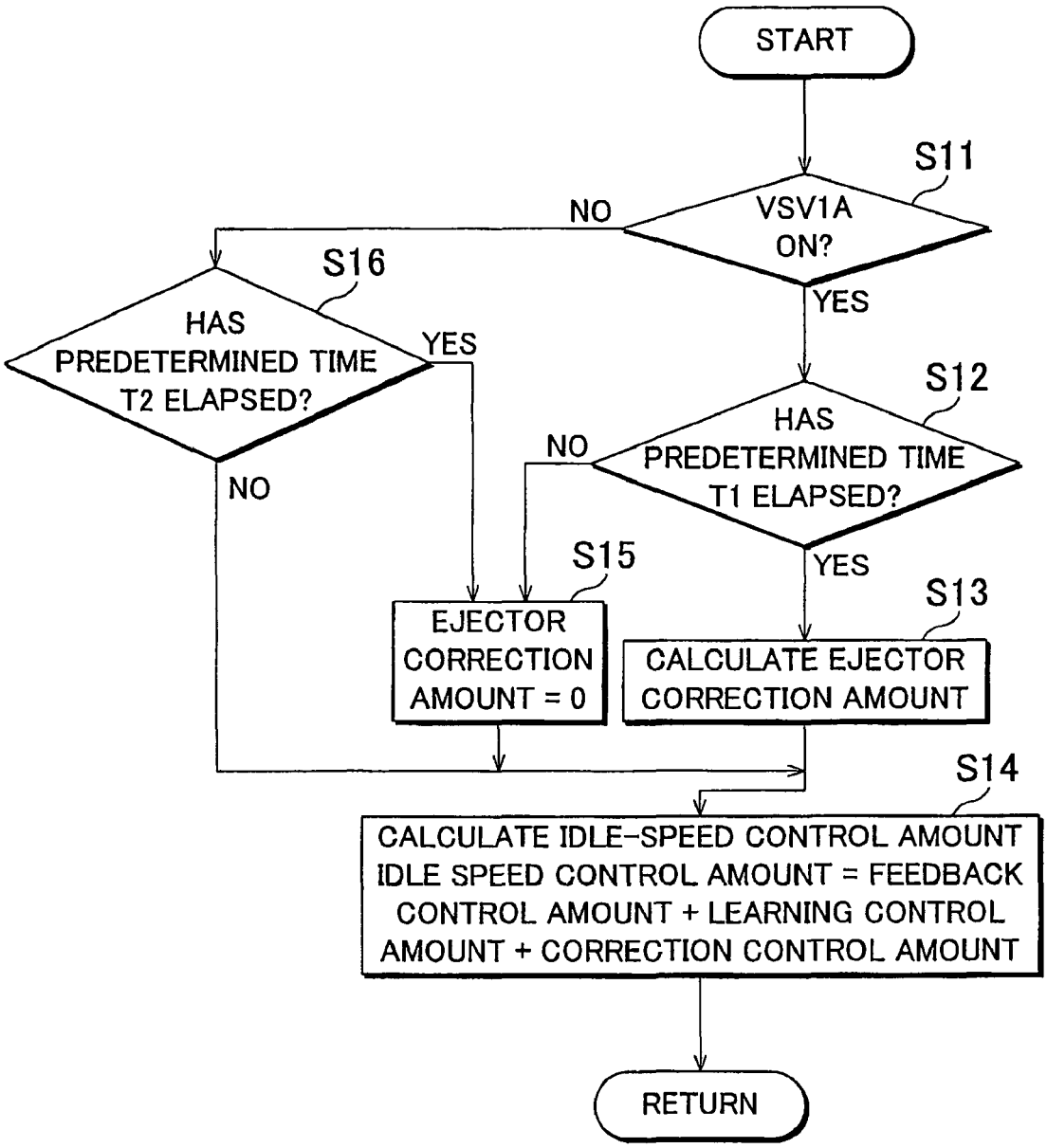
FIG. 3 is the flowchart showing the routine executed by an ECU 40 according to the first embodiment of the invention.

Next, the routine executed by the ECU 40A to correct the idle-speed control amount by the ejector correction amount based on the operating state of the vacuum switching valve 1A will be described with reference to the flowchart shown in FIG. 3. The CPU periodically executes the routine shown in the flowchart at considerably short intervals based on the idle-speed control amount correction program, etc. stored in the ROM, whereby the ECU 40A controls the electric throttle valve system 13. The CPU determines whether the vacuum switching valve 1A is controlled to cause the ejector 30 to operate (hereinafter, simply referred to as "the vacuum switching valve 1A is opened") (step S11). The CPU checks the status of the internal processing based on the program used to control the vacuum switching valve 1A executed by the ECU 40A, whereby whether the vacuum switching valve 1A is opened is determined. However, the manner in which whether the vacuum switching valve 1A is opened is determined is not limited to this. When the vacuum switching valve 1A is provided with a limit switch that detects the operating state of the vacuum switching valve 1A, whether the vacuum switching valve 1A is opened may be determined based on the signal output from the limit switch.

Figure 4:
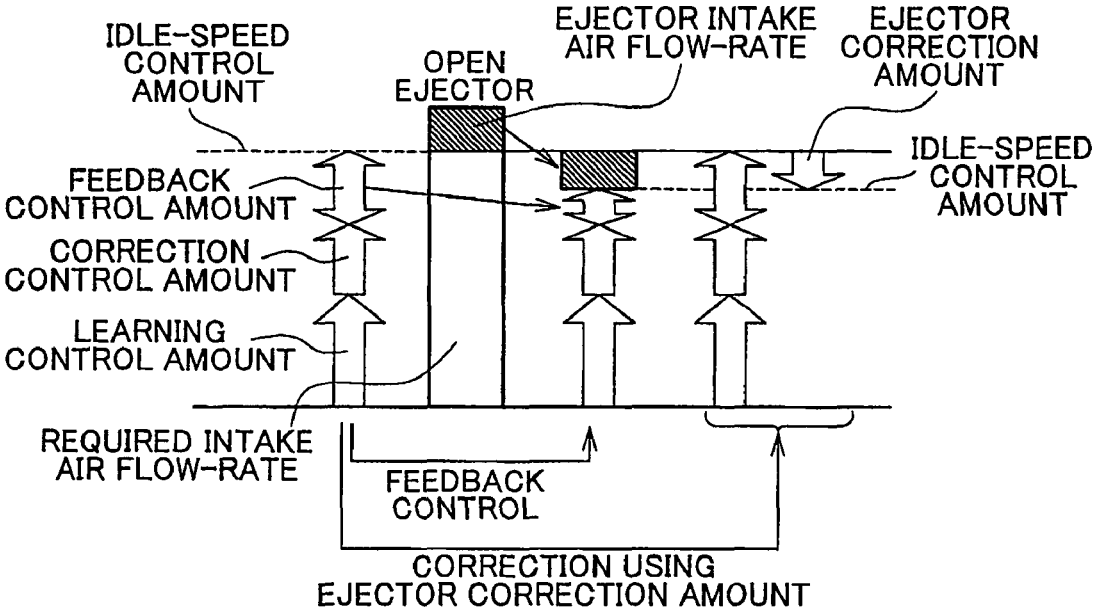
FIG. 4 is the view conceptually showing the correction of the idle-speed control amount in step S14 in the flowchart.

If an affirmative determination is made in step S1, the CPU determines whether a predetermined time T1 has elapsed since the vacuum switching valve 1A is opened (step S12). The predetermined time T1 is set to determine an appropriate time at which the electric throttle valve system 13 may be controlled by the idle-speed control amount, which is corrected by the ejector correction amount, based on the actually increasing intake air flow-rate. If an affirmative determination is made in step S12, the CPU calculates the ejector correction amount appropriate for the increasing intake air flow-rate (step S13). Because used to correct the idle-speed control amount to suppress an increase in the intake air flow-rate, the ejector correction amount is calculated as a negative value. Next, the CPU calculates the idle-speed control amount by adding the feedback control amount, the learning control amount and the correction control amount together (step S14). According to the first embodiment of the invention, because the ejector control amount is calculated as one of the correction control amounts, the idle-speed control amount is corrected by the ejector correction amount. Because the ejector correction amount is a negative value, the idle-speed control amount is decreased by the ejector correction amount. FIG. 4 conceptually shows the correction of the idle-speed control amount in step S14. When the vacuum switching valve 1A is kept open, steps 11 to 14 are periodically executed, whereby the idle-speed control amount is continuously corrected by the ejector correction amount. On the other band, if a negative determination is made in step S12, the CPU sets the ejector correction amount to zero (step S15). Thus, during the period after the vacuum switching valve 1A is opened and before the appropriate time at which the electric throttle valve system 13 may be controlled by the idle-speed control amount that is corrected by the ejector correction amount, the idle-speed control amount, which is not corrected by the ejector correction amount, is calculated in step S14.

On the other hand, if a negative determination is made in step S11, the CPU determines that the vacuum switching valve 1A is controlled to cause the ejector 30 to stop operating (hereinafter, simply referred to as "the vacuum switching valve 1A is closed"). Then, the CPU determines whether a predetermined time T2 has elapsed since the vacuum switching valve 1A is closed (step S16). The predetermined time T2 is set to determine an appropriate time at which the electric throttle valve system 13 may be controlled by the idle-speed control amount that is not corrected by the ejector correction amount based on the actually decreasing intake air flow-rate. If an affirmative determination is made in step S16, the CPU sets the ejector correction amount to zero (step S15). Thus, the idle-speed control amount is not corrected by the ejector correction amount in step S14. On the other hand, if a negative determination is made in step S16, the CPU executes step S14. Thus, during the period after the vacuum switching valve 1A is closed and before the appropriate time at which the electric throttle valve system 13 may be controlled by the idle-speed control amount that is not corrected by the ejector correction amount based on the actually decreasing intake air flow-rate, the idle-speed control amount that is corrected by the ejector correction amount is calculated in step S14. According to the first embodiment of the invention, fluctuations in the intake air flow-rate, which are inevitable in the feedback control, are suppressed by correcting the idle-speed control amount by the ejector correction amount. Thus, fluctuations in the idle speed are appropriately suppressed. With the configuration described so far, it is possible to implement the ECU 40A that appropriately suppresses fluctuations in the idle speed of the internal combustion engine 50 even if the ejector 30 is caused to operate or caused to stop operating.

Next, a second embodiment of the invention will be described. An ECU 40B according to the second embodiment of the invention is mostly the same as the ECU 40A according to the first embodiment of the invention except that the ROM of the ECU 40B further stores the control amount learning prohibition program used to prohibit the execution of learning when the ejector 30 is operating based on the operating state of a vacuum switching valve 1B. Although the vacuum switching valve in the second embodiment of the invention is referred to as the vacuum switching valve 1B for convenience in description, the vacuum switching valve 1B is the same as the vacuum switching valve 1A. According to the second embodiment of the invention, a control amount learning prohibition device is implemented by the CPU, etc. and the control amount learning prohibition program. An idle-speed control unit according to the second embodiment of the invention is implemented by the ECU 40B. The idle-speed control program according to the second embodiment further includes the control amount learning prohibition program in addition to the programs included in the idle-speed control program according to the first embodiment of the invention. The idle-speed control device according to the second embodiment further includes the control amount learning prohibition device in addition to the devices included in the idle-speed control devices according to the first embodiment of the invention. The control amount learning prohibition program may be included in the control amount learning program, and the control amount learning prohibition device may be included in a learning device. According to the second embodiment of the invention, an ejector system 100B is implemented by the vacuum switching valve 1B, the ejector 30, and the ECU 40B. The components of the vehicle in which the ECU 40B is mounted are the same as those shown in FIG. 1 other than the ECU 40A.

Figure 5:
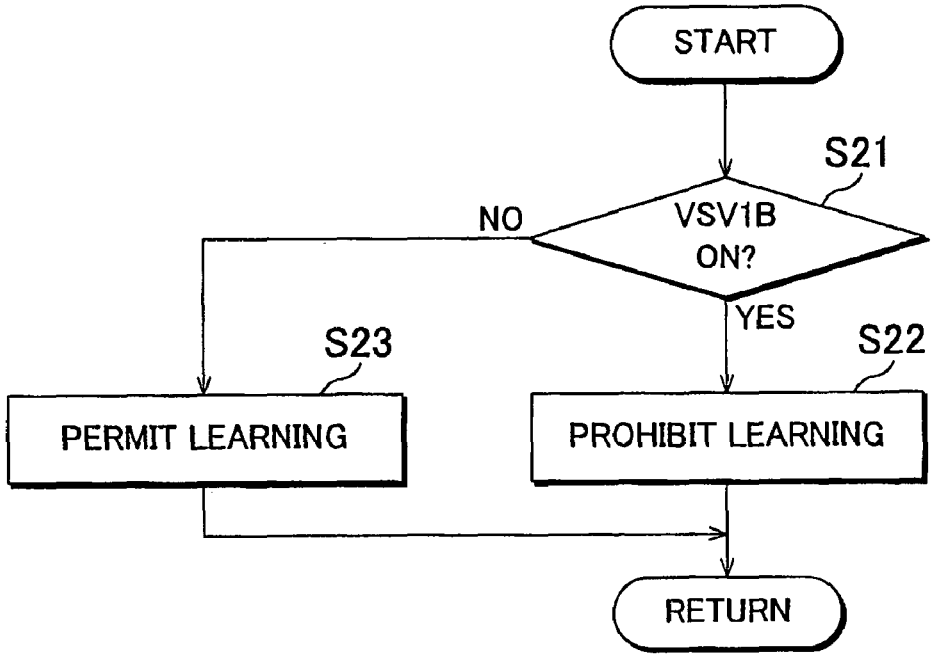
FIG. 5 is the flowchart showing the routine executed by an ECU 40B according to a second embodiment of the invention.

The routine executed by the ECU 40B to determine whether the learning is permitted or prohibited based on the operating state of the vacuum switching valve 1B will be described in detail with reference to the flowchart shown in FIG. 5. The CPU periodically executes the routine shown in the flowchart at considerably short intervals based on the control amount learning prohibition program stored in the ROM, whereby the leaning is permitted or prohibited. The CPU determines whether the vacuum switching valve 1B is opened (step S21). If an affirmative determination is made, the CPU prohibits the learning (step S22). Thus, it is possible to prevent execution of the learning when the intake air flow-rate is transiently changing. When the vacuum switching valve 1B is kept open, prohibition of the learning is maintained by periodically executing steps S21 and S22. Thus, it is possible to prohibit the learning when the ejector 30 is operating, and to prevent the state, in which the intake air flow-rate increases because the ejector 30 is operating, from being reflected on the learning control amount. On the other hand, if a negative determination is made in step S21, the CPU permits the learning (step S23). Thus, it is possible to execute the learning again. A time at which step S23 is executed may be set after a negative determination is made in step S21 so that the learning is not executed when the intake air flow-rate is transiently changing. With the configuration described so far, it is possible to implement the ECU 50B that appropriately suppresses large fluctuations in the idle speed by prohibiting the learning while the ejector is operating.

Next, a third embodiment of the invention will be described. An ECU 40C according to the third embodiment of the invention is mostly the same as the ECU 40A according to the first embodiment of the invention except that the ROM of the ECU 40C further stores the control speed changing program used to increase the control speed of the feedback control executed in accordance with a change in the operating state of a vacuum switching valve 1C. Although the vacuum switching valve in the third embodiment of the invention is referred to as the vacuum switching valve 1C for convenience in description, the vacuum switching valve 1C is the same as the vacuum switching valve 1A. According to the third embodiment of the invention, a control speed changing device is implemented by the CPU, etc., and the control speed changing program, and the idle-speed control unit is implemented by the ECU 40C. The idle-speed control program according to the third embodiment further includes the control speed changing program in addition to the programs included in the idle-speed control program according to the first embodiment of the invention. The idle-speed control device according to the third embodiment further includes the control speed changing device in addition to the devices included in the idle-speed control device according to the first embodiment of the invention. The control speed changing program may be included in the feedback control amount changing program, and the control speed changing device may be included in the feedback control device. According to the third embodiment of the invention, an ejector system 100C is implemented by the vacuum switching valve 1C, the ejector 30, and the ECU 40B. The components of the vehicle in which the ECU 40C is mounted are the same as those shown in FIG. 1 other than the ECU 40A.

Figure 6:
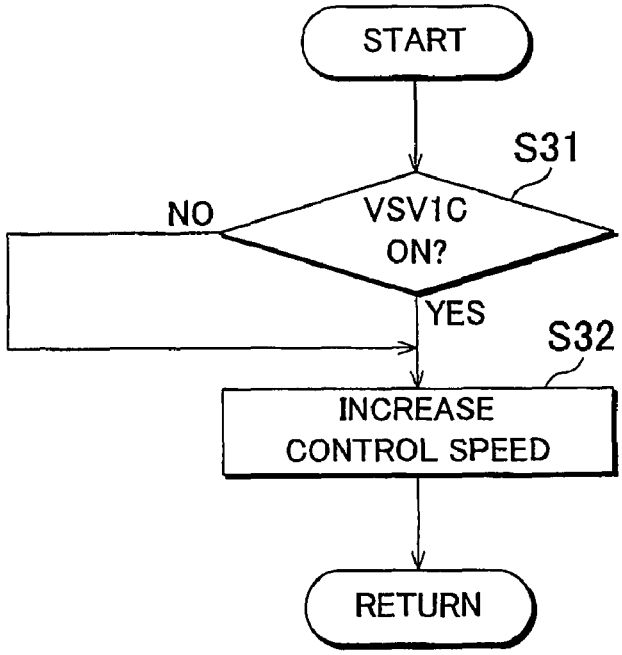
FIG. 6 is the flowchart showing the routine executed by an ECU 40C according to a third embodiment of the invention.

Next, the routine executed by the ECU 40 to increase the control speed of the feedback control executed based on the operating state of the vacuum switching valve 1C will be described in detail with reference to the flowchart shown in FIG. 6. The CPU periodically executes the routine shown in the flowchart at considerably short intervals based on the control speed changing program stored in the ROM, whereby the control speed is increased. The CPU determines whether vacuum switching valve 1C is opened (step S31). In step S31, it is determined only whether the operating state of the vacuum switching valve 1C is changed, namely, it is determined only whether the vacuum switching valve 1C is opened. If an affirmative determination is made in step S31, the CPU increases the control speed (step S32). More specifically, before the correction amount (feedback correction amount) used to change the feedback control amount is calculated, the gain of the proportional in the equation for calculating the feedback control amount is increased. Thus, the feedback control amount is changed by a larger amount. As a result, the control speed is increased.

At the same time, the gain of the integral term in the equation for calculating the feedback correction amount is increased before the feedback correction amount is calculated. Thus, even if the feedback control amount is changed by a larger amount, the feedback control amount is made substantially equal to the target feedback control amount promptly. If this process is not executed, it is difficult to make the feedback control amount substantially equal to the target feedback control amount promptly depending on the gain of the proportional. Therefore, this process is also included in the process for increasing the control speed, according to the third embodiment of the invention. Even if a negative determination is made in step S31, the CPU executes step S32. Thus, even if the ejector 30 is caused to operate or caused to stop operating, the fluctuations in the intake air flow-rate are suppressed promptly, whereby the idle speed is stabilized promptly. With the configuration described so far, it is possible to implement an ECU 40C that stabilizes the idle speed promptly by increasing the control speed of the feedback control executed in accordance with a change in the operating state of the vacuum switching valve 1C.

Next, a fourth embodiment of the invention will be described. An ejector system 100D for a vehicle according to the fourth embodiment of the invention is mostly the same as the ejector system 100A except that the ejector system 100D includes a vacuum switching valve 1D that is structured to change the intake air flow-rate by controlling the flow passage area of the passage instead of the vacuum switching valve 1A, and the ejector system 100D includes an ECU 40D that stores, in the ROM, the gradual change control program used to gradually control the opening amount of the vacuum switching valve 1D to gradually increase or decrease the flow passage area of the passage of the vacuum switching valve 1D at a predetermined rate instead of the ECU 40A. According to the fourth embodiment of the invention, the ECU 40D is mostly the same as the ECU 40A except that the ECU 40D stores the gradual change control program in the ROM. However, any types of ECUs that store at least the gradual change control program in ROM may be employed. According to the fourth embodiment of the invention, a gradual change control device is implemented by the CPU, etc., and the gradual change control program. The ejector system 100D is implemented by the ejector 30, and the ECU 40D. The components of the vehicle in which the ECU 40D is mounted are mostly the same as those shown in FIG. 1 except the vacuum switching valve 1D and the ECU 40D.

Figure 7:
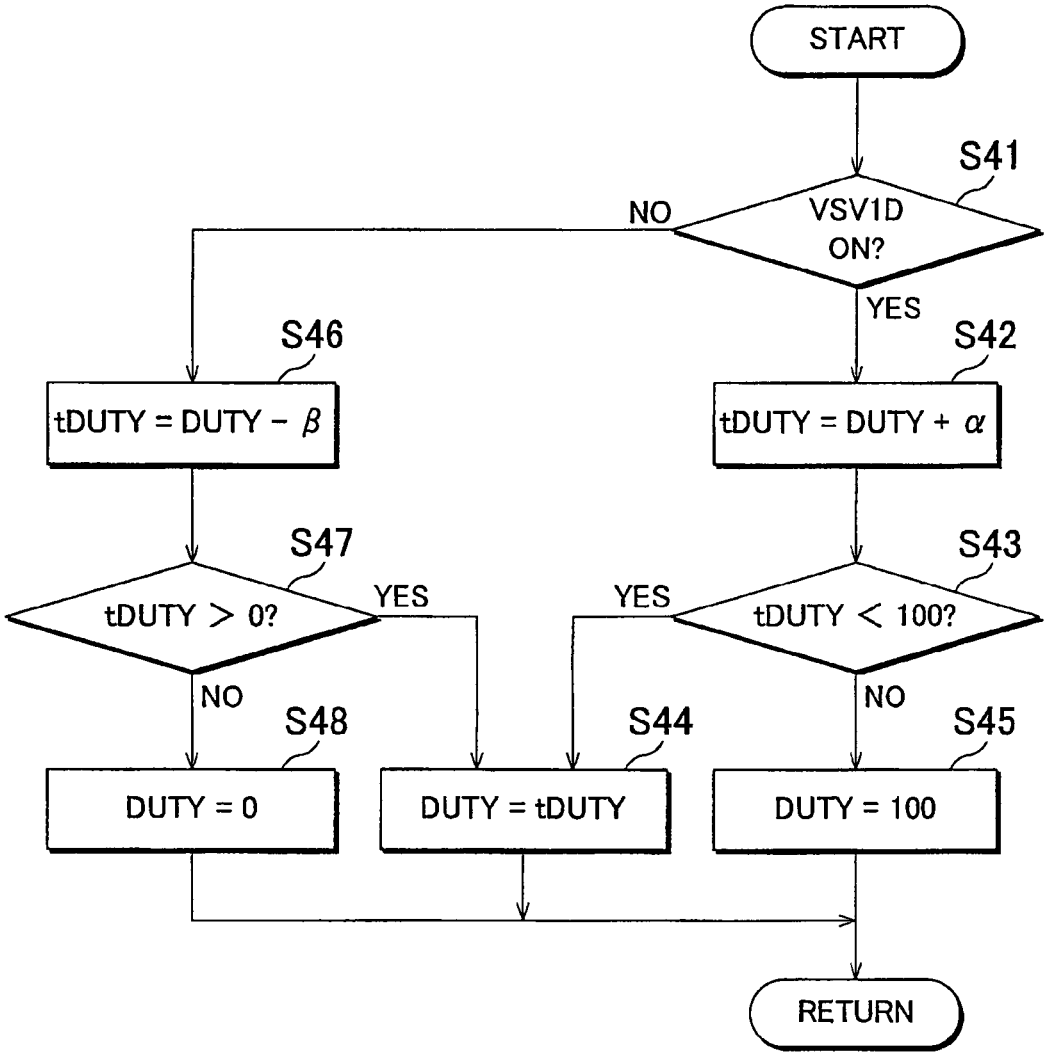
FIG. 7 is the flowchart showing the routine executed by an ECU 40D according to a fourth embodiment of the invention.

Next, the routine executed by the ECU 40D to execute the gradual change control on the vacuum switching valve 1D based on the operating state of the vacuum switching valve 1D will be described with reference to the flowchart shown in FIG. 7. The CPU periodically executes the routine shown in the flowchart at considerably short intervals based on the gradual change control program stored in the ROM, whereby the ECU 40D executes the gradual change control on the vacuum switching valve 1D. The CPU determines whether the vacuum switching valve 1D is opened (step S41). If an affirmative determination is made, the temporary control amount tDUTY is calculated by adding the predetermined control amount a to the control amount DUTY used in the gradual change control executed on the vacuum switching valve 1D (step S 42). The control amount DUTY used to control the vacuum switching valve 1D so that the passage is fully closed is set to zero, and the control amount DUTY used to control the vacuum switching valve 1D so that the passage is fully opened is set to 100. Next, the CPU determines whether the temporary control amount tDUTY is less than 100 (step S43). If an affirmative determination is made, the CPU updates the control amount DUTY to the temporary control amount tDUTY (step S44). Thus, steps 41, 42, 43 and 44 are periodically executed until a negative determination is made in step S43, whereby the control amount DUTY is gradually increased by the control amount a each time. Namely, it is possible to control the vacuum switching valve 1D so that the passage of the vacuum switching valve 1D is gradually opened at a predetermined rate. On the other hand, if a negative determination is made in step S43, the CPU sets the control amount DUTY to 100 (step S45). Thus, when the vacuum switching valve 1D is kept open, the passage of the vacuum switching valve 1D is maintained fully open.

On the other hand, if a negative determination is made in step S41, the CPU calculates the temporary control amount tDUTY by subtracting the predetermined control amount β from the control amount DUTY (step S46). Next, the CPU determines whether the temporary control amount tDUTY is greater than zero (step S47). If an affirmative determination is made, the CPU updates the control amount DUTY to the temporary control amount tDUTY. Thus, steps 41, 46, 47 and 44 are periodically executed until a negative determination is made in step S47, whereby the control amount DUTY is gradually decreased by the control amount β each time. Thus, it is possible to control the vacuum switching valve 1D so that the passage of the vacuum switching valve 1D is gradually closed at a predetermined rate. On the other hand, if a negative determination is made in step S47, the CPU sets the control amount DUTY to zero (step S48). Thus, when the vacuum switching valve 1D is kept closed, the passage of the vacuum switching valve 1D is maintained fully closed.

If the gradual change control is executed on the vacuum switching valve 1D, abrupt fluctuations in the intake air flow-rate are suppressed. Therefore, with the ejector system 100D according to the fourth embodiment of the invention, even if a delayed response to the detection of the transiently changing intake air flow-rate is given, the feedback control in the idle-speed control is easily executed using the intake air flow-rate that accurately coincides with the actual intake air flow-rate. Accordingly, it is possible to suppress large fluctuations in the idle speed. With the ejector system 100D according to the fourth embodiment of the invention, it is possible to suppress abrupt fluctuations in the intake air flow-rate. Accordingly, not only when the engine is idling but also when the accelerator pedal is depressed relatively slightly, it is possible to suppress occurrence of torque shock, which is felt by a driver, in the internal combustion engine 50. The certain program stored in the ROM of the ejector system 100D according to the fourth embodiment of the invention makes it possible to switch the control mode for the vacuum switching valve 1D based on the operating state of the internal combustion engine 50. For example, when the engine is idling or when the vehicle is accelerating only slightly, the gradual change control is executed on the vacuum switching valve 1D. When the vehicle is accelerating with the throttle valve fully opened, the ON/OFF control is executed on the vacuum switching valve 1D. With the configuration described so far, it is possible to implement the ejector system 100D that suppresses large fluctuations in the idle speed by executing the gradual change control on the vacuum switching valve 1D.

Next, a fifth embodiment of the invention will be described. An ECU 40E according to the fifth embodiment of the invention is mostly the same as the ECU 40A according to the first embodiment of the invention except that the ROM of the ECU 40E further stores the control amount learning prohibition program described in the second embodiment of the invention and the specific control amount learning program in addition to the programs according to the first embodiment of the invention. According to the specific control amount learning program, the control amount used to control the electric throttle valve system 13 is learned so that the intake air flow-rate is maintained at the target intake air flow-rate when a vacuum switching valve 1E is closed after the deviation of the intake air flow-rate from the target intake air flow-rate is equal to or greater than a predetermined value when the vacuum switching valve 1E is opened. The components of the vehicle in which the ECU 40E is mounted are the same as those shown in FIG. 1 others than the ECU 40A. The specific control amount learning program according to the fifth embodiment of the invention is prepared so that the learning of the control amount is executed by increasing or decreasing the ejector correction amount by an increase or decrease in a feedback control amount (the feedback correction amount) caused by the feedback control that is executed when the deviation of the intake air flow-rate from target intake air flow rate is equal to or greater than the predetermined value when the vacuum switching valve 1E is opened. The specific control amount learning program is prepared so that the learning is executed when the intake air flow-rate is made substantially equal to the target intake air flow-rate by the feedback control.

For example, when the feedback control amount is increased, the intake air flow-rate needs to be increased by the ejector correction amount. Meanwhile, in the idle-speed control, the idle-speed control amount is decreased by the ejector correction amount. In this case, the learning of the control amount is executed by decreasing the ejector correction amount by an increase in the feedback control amount. Also, according to the fifth embodiment of the invention, the specific control amount learning program and the control amount learning program are prepared independently of each other. Accordingly, the ECU 1E stores also the control amount learning prohibition program in the ROM so that the learning of the ejector correction amount is executed without executing the learning of the learning control amount when the ejector 30 is operating. Although the vacuum switching valve in the fifth embodiment of the invention is referred to as the vacuum switching valve 1B for convenience in description, the vacuum switching valve 1E is the same as the vacuum switching valve 1A.

According to the fifth embodiment of the invention, a specific control amount learning device is implemented by the CPU, etc., and the specific control amount learning program; the control amount learning prohibition device is implemented by the CPU, etc., and the control amount learning prohibition program; and the idle-speed control unit is implemented by the ECU 40E. According to the fifth embodiment of the invention, the specific control amount learning program and the control amount learning prohibition program are included in the idle-speed control program. Accordingly, the idle-speed control device further includes the specific control amount learning device and the control amount learning prohibition device in addition to the devices according to the first embodiment of the invention. An ejector system 100E is implemented by the vacuum switching valve 1E, the ejector 30 and the ECU 40E. The components of the vehicle in which the ECU 40E is mounted are the same as those shown in FIG. 1 except the vacuum switching valve 1E and the ECU 40E.

Figure 8:
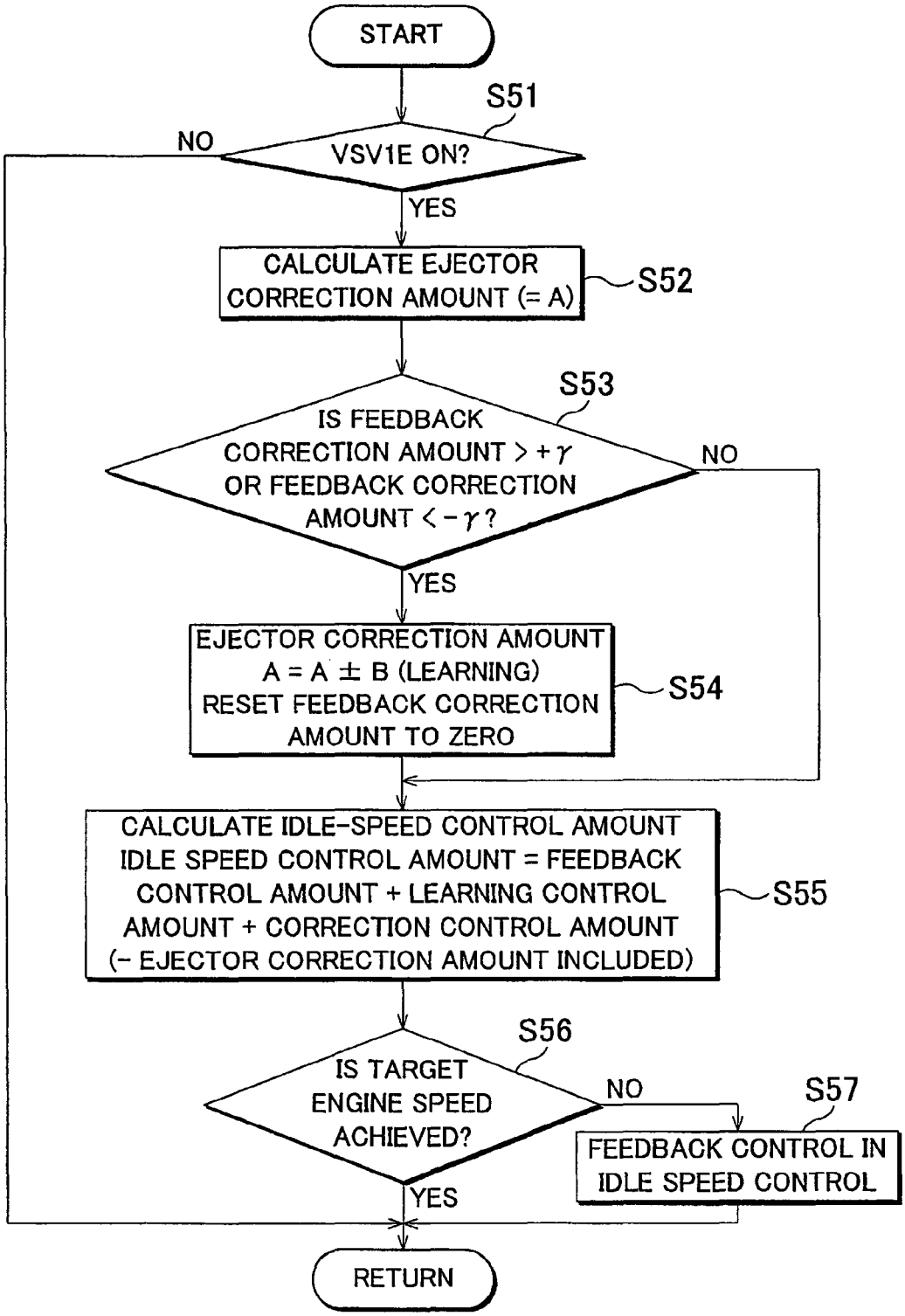
FIG. 8 is the flowchart showing the routine executed by an ECU 40E according to a fifth embodiment of the invention.

Next, the routine executed by the ECU 1E will be described with reference to the flowchart shown in FIG. 8, and an example of the time-chart shown in FIG. 9 which corresponds to the flowchart in FIG. 8 will be described in detail. The CPU periodically executes the routine shown in the flowchart in FIG. 8 at considerably short intervals based on the specific control amount learning program stored in the ROM, whereby the ECU 40E controls the electric throttle valve system 13. The CPU determines whether the vacuum switching valve 1E is opened (step S51). If a negative determination is made in step S51, the following steps need not be executed in the current routine. Accordingly, the current routine ends, and step S51 is executed again. On the other hand, if an affirmative determination is made in step S51, the CPU calculates the ejector correction amount (A) (step S52). According to the fifth embodiment of the invention, the predetermined time T1 is set to zero.

Next, the CPU determines whether the feedback correction amount is greater than +γ (the positive value of the predetermined value γ) or less than −γ (the negative value of the predetermined value γ) (step S53). Namely, it is determined whether the intake air flow-rate deviates from the target intake air flow-rate by an amount equal to or greater than the predetermined value. According to the fifth embodiment of the invention, the predetermined value γ is set based on the allowable range with respect to the target intake air flow-rate. The fluctuation in the intake air flow-rate within the allowable range is allowable. Because the idle speed is maintained at the target speed in the steady state, the feedback correction amount when the vacuum switching valve 1E is opened is basically substantially zero. Accordingly, immediately after the vacuum switching valve 1E is opened, two negative determinations are made in step S53. In this case, step S55 is executed. In step S55, the CPU calculates the idle-speed control amount (step S55). Thus, the idle-speed control amount is decreased by the ejector correction amount.

Figure 9:
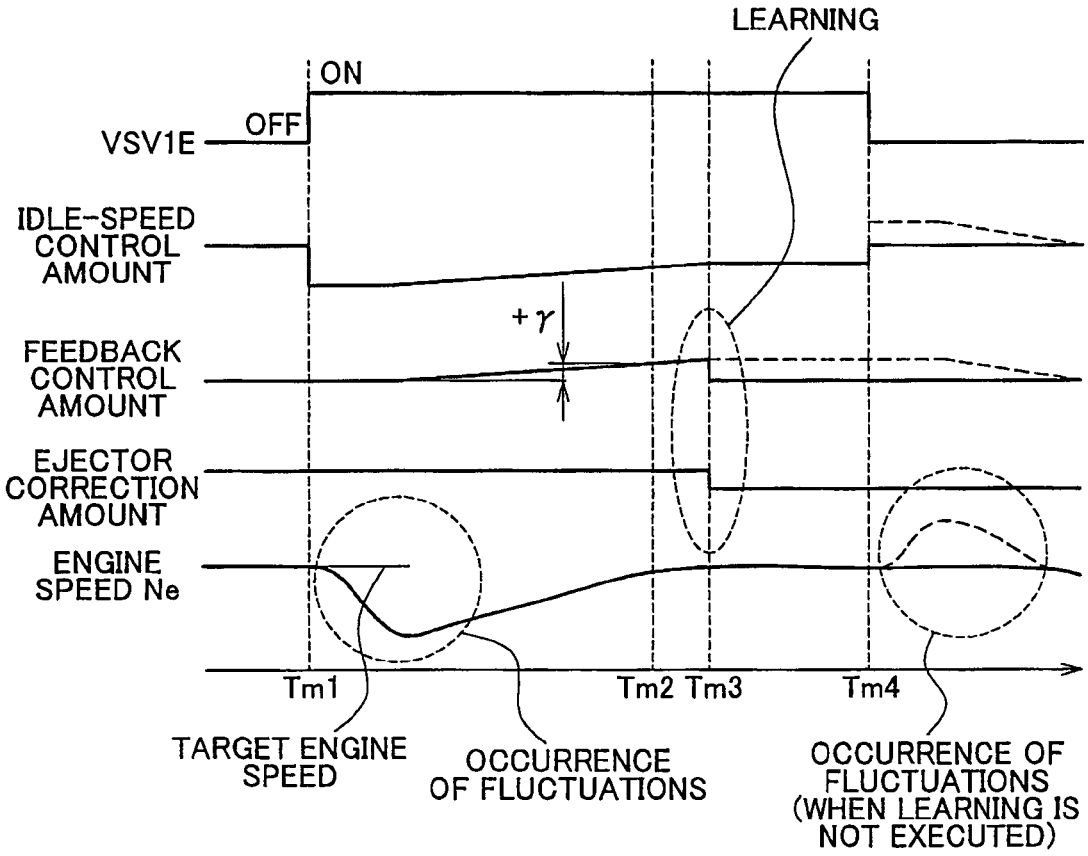
FIG. 9 shows an example of the time chart corresponding to the flowchart in FIG. 8.

In the time-chart in FIG. 9, the process described so far corresponds to the changes until time Tm1. At time Tm1, the vacuum switching valve 1E is opened, and the idle-speed control amount is decreased by the ejector correction amount. At this time, the engine speed Ne is maintained at the target speed, and the feedback correction amount is zero.

Next, the CPU determines whether the engine speed Ne is equal to the target speed (step S56). If the intake air flow-rate becomes equal to the target intake air flow-rate as a result of correction of the idle-speed control amount made using the ejector correction amount, an affirmative determination is made in step S56. In this case, the following steps need not be executed. Accordingly, the current routine ends, and step S51 is executed again. On the other hand, if a negative determination is made in step S56, it is determined that the intake air flow-rate deviates from the target intake air flow-rate although the idle-speed control amount is corrected by the ejector correction amount. The CPU then controls the intake air flow-rate in a feedback manner (step S57), and executes step S51 again. When the intake air flow-rate deviates from the target intake air flow-rate, the CPU periodically executes steps 51, 52, 53, 55, 56 and 57 until any one of the two determinations made in step S53 is affirmative.

In the time-chart in FIG. 9, the process described so far corresponds to the changes from time Tm1 to time Tm2. The time-chart shown in FIG. 9 shows changes when the intake air flow-rate slightly deviates from the target intake air flow-rate. Accordingly, the engine speed Ne is lower than the target speed after time Tm1. Because the feedback control is then executed, the feedback correction amount increases, and the engine speed Ne also gradually increases.

On the other hand, when the feedback correction amount becomes greater than the predetermined value γ as a result of the control of the intake air flow-rate executed in a feedback manner in step S57, an affirmative determination is made in step S53. At this time, the CPU increases or decreases the value A of the ejector correction amount by an increase or a decrease in the feedback control amount, namely, the feedback correction amount (B), and resets the feedback correction amount to zero (step S54). Namely, the learning of the control amount is executed in step S54, and the value A of the ejector correction amount is updated to a new value. Step S54 is executed when the intake air flow-rate is made substantially equal to the target intake air flow-rate by the feedback control. Accordingly, it is also determined in step S53 whether an affirmative determination is made in step S56 in the immediately preceding routine. If this determination is negative, a negative determination is made in step S53 even if the feedback correction amount is greater than the predetermined value γ.

As a result, the idle-speed control amount is corrected by the learned ejector correction amount in step 55 in the current routine and the subsequent routines. Accordingly, it is possible to suppress fluctuations in the idle speed when the vacuum switching valve 1E is closed. When the vacuum switching valve 1E is then opened, the ejector correction amount, which is updated through the learning, is calculated in step S52. Accordingly, it is possible to suppress fluctuations in the idle speed also at this time.

In the time-chart in FIG. 9, the process described so far corresponds to the changes between time tm2 and time Tm3. The time Tm2 shows the time at which the feedback correction amount becomes greater than the predetermined value γ. Time Tm3 shows the time at which the ejector correction amount is learned and the idle-speed control amount is corrected by the ejector correction amount.

As shown in the time-chart, when the vacuum switching valve 1E is closed at time Tm4, the idle-speed control amount increases by an amount corresponding to the ejector correction amount because the correction using the ejector correction amount is cancelled. At this time, the engine speed Ne does not fluctuate. When the learning of the ejector correction amount is not executed, if the correction of the idle-speed control amount using the ejector correction amount is cancelled at time Tm4, the idle-speed control amount further increases by an amount corresponding to the feedback correction amount, as shown by the dashed line. Therefore, when the learning of the ejector correction amount is not executed, the engine speed Ne also increases as shown by the dashed line, and the fluctuations in the engine speed Ne need to be suppressed by the feedback control. Accordingly, the feedback correction amount changes, as shown by the dashed line.

To suppress the fluctuations in the idle speed within the allowable range, for example, the ejector correction amount may be increased or decreased by the predetermined value γ in step S54. This is implemented by preparing the specific control amount learning program used to learn the control amount used to control the electric throttle valve system 13 so that the intake air flow-rate falls within the fluctuation allowable range with respect to the target intake air flow-rate, more specifically, according to the fifth embodiment of the invention, the feedback correction amount is increased or decreased by the predetermined value γ, if the vacuum switching valve 1E is closed after the deviation of the intake air flow-rate from the target intake air flow-rate is equal to or greater than the predetermined value when the vacuum switching valve 1E is opened. At this time, an affirmative determination may be made if it is determined in step S53 that the feedback correction amount is greater than the predetermined value γ regardless of the result of the other determination. At this time, unlike immediately after the vacuum switching valve 1E is opened, the intake air flow-rate does not abruptly change. Accordingly, the possibility that the leaning is not executed appropriately is reduced. With the configuration described so far, it is possible to implement the ECU 40E that appropriately suppresses fluctuations in the idle speed of the internal combustion engine 50 even if the ejector 30 is caused to operate or caused to stop operating Next, a sixth embodiment of the invention will be described. An ECU 40F according to the sixth embodiment of the invention is mostly the same as the ECU 40A according to the first embodiment of the invention except that the ejector correction amount calculation program further includes the ejector correction amount changing program described below in addition to the programs according to the first embodiment of the invention, and the ROM further stores the ejector correction amount map data in addition to the data described in the first embodiment of the invention. The ejector correction amount changing program is used to change the ejector correction amount based on the ejector upstream-downstream pressure difference that is the difference between the pressure on the inlet side of the ejector 30 (for example, the pressure in the intake passage, at a position upstream of the throttle valve 13*a*) and the pressure on the outlet side of the ejector 30 (for example, the pressure in the intake manifold 14). According to the sixth embodiment of the invention, the ejector correction amount changing program is prepared so that the ejector correction amount is read from the ejector correction amount map data based on the engine speed Ne and the intake air flow-rate, and the ejector correction amount is changed to the read ejector correction amount. Accordingly, in the ejector correction amount map data, the ejector correction amount is defined based on the engine speed Ne and the intake air flow-rate.

The components of the vehicle in which the ECU 40F is mounted are the same as those in FIG. 1 other than the ECU 40A. The ejector correction amount changing program may be stored in the ROM of the ECU 40E according to the fifth embodiment of the invention. Although the vacuum switching valve in the sixth embodiment of the invention is referred to as a vacuum switching valve 1F for convenience in description, the vacuum switching valve 1F is the same as the vacuum switching valve 1A. According to the sixth embodiment of the invention, an ejector correction amount changing device is implemented by the CPU, etc., and the ejector correction amount changing program, and the idle-speed control unit is implemented by the ECU 40F. The ejector correction amount changing program is included in the idle-speed control program. Therefore, the idle-speed control device according to the sixth embodiment of the invention further includes the ejector correction amount changing device. An ejector system 100F is implemented by the vacuum switching valve 1F, the ejector 30 and the ECU 40F. The components of the vehicle in which the ECU 40F is mounted are the same as those shown in FIG. 1 except the vacuum switching valve 1F and the ECU 40F.

Next, the routine executed by the ECU 40F according to the sixth embodiment of the invention will be described in detail with reference to FIG. 10. Step S61 and steps S64 to S66 are the same step S51 and steps S55 to S57 in the flowchart in FIG. 8, respectively. Therefore, steps 62 and 63 will be described in detail in the sixth embodiment of the invention. If an affirmative determination is made in step S61, the CPU detects the engine speed Ne and the intake air flow-rate (step S62). According to the sixth embodiment of the invention, the predetermined time T1 is set to zero. Next, the CPU reads the ejector correction amount from the map data of the ejector correction amount based on the detected speed Ne and intake air flow-rate, and changes the ejector correction amount to the read ejector correction amount (step S63). Thus, the ejector correction amount is changed based on ejector upstream-downstream pressure difference.

Figure 10:
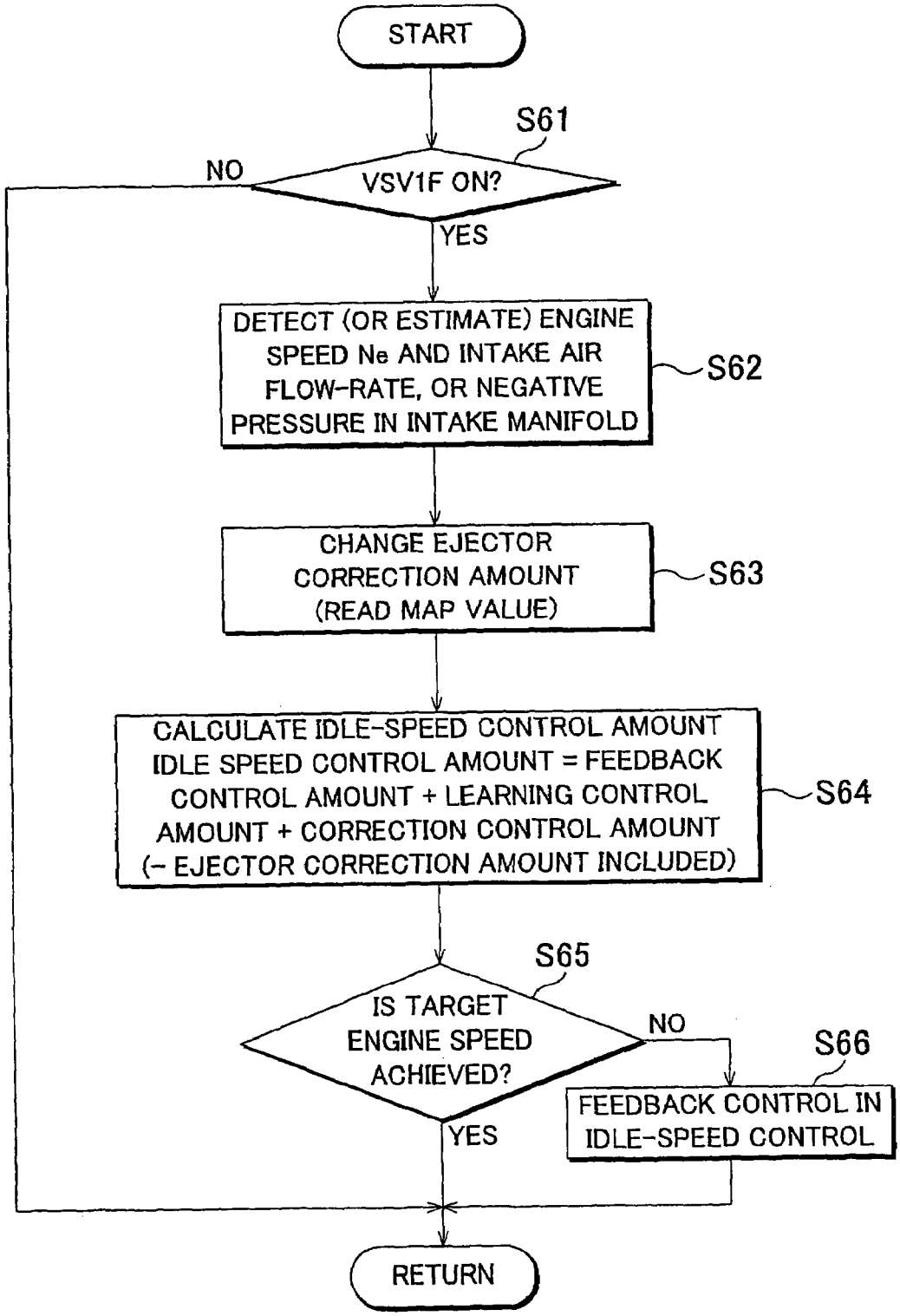
FIG. 10 is the flowchart showing the routine executed by an ECU 40F according to a sixth embodiment of the invention.

As shown in FIG. 10, for example, the negative pressure in the intake manifold may be detected or estimated in step S62 instead of detecting the engine speed Ne and the intake air flow-rate, and the ejector correction amount may be changed based on the negative pressure in the intake manifold in step S63. For example, the ejector correction amount map data that defines the ejector correction amount based on the negative pressure in the intake manifold instead of the engine speed Ne and the intake air flow-rate may be stored in the ROM. Also, the ejector correction amount changing program may be prepared so that the ejector correction amount is read from the ejector correction amount map data based on the negative pressure in the intake manifold, and the ejector correction amount is changed to the read ejector correction amount.

For example, the ejector correction amount may be set to a constant value corresponding to the maximum flow-rate of the intake air that flows through the ejector, and the ejector correction amount may be multiplied by a modification coefficient used to modify the ejector correction amount, whereby the ejector correction amount is changed based on the ejector upstream-downstream pressure difference. The modification coefficient may be set to a value that changes the ejector correction amount to a value corresponding to the ejector upstream-downstream pressure difference by being multiplied by the ejector correction amount. For example, the modification coefficient map data that defines the modification coefficient may be stored in the ROM instead of the ejector correction amount map data. The ejector correction amount changing program may be prepared so that the modification coefficient is read from the modification coefficient map data based on the engine speed Ne and the intake air flow-rate (or the negative pressure in the intake manifold), and the ejector correction amount is multiplied by the read modification coefficient. With the configuration described so far, it is possible to implement the ECU 40F that appropriately suppresses fluctuations in the idle speed of the internal combustion engine 50 even when the ejector 30 is caused to operate or caused to stop operating.

Next, a seventh embodiment of the invention will be described. According to the seventh embodiment of the invention, the response correction control amount calculation program (hereinafter, simply referred to as the "calculation program" where appropriate) is stored in the ROM. According to the response correction control amount calculation program the response correction control amount eqeject is calculated, which is used to control the electric throttle valve system 13 so that the intake air flow-rate increases when a vacuum switching valve 1G is controlled to cause the ejector 30 to operate (hereinafter, simply referred to as "a vacuum switching valve 1G is opened" where appropriate). The response correction control amount eqeject is the control amount used to control the electric throttle valve system 13 so that the intake air flow-rate is increased by the estimated intake air flow-rate corresponding to a final increase in the intake air flow-rate when the vacuum switching valve 1G is opened. The calculation program further includes the program used to change the response correction control amount eqeject so that the intake air flow-rate gradually decreases. According to this program, the response correction control amount equject is changed so that the intake air flow-rate gradually decreases as the flow-rate of the intake air that actually flows through the bypass passage B gradually increases.

The estimated intake air flow-rate is set in advance based on the results of measurements such as a bench test, and stored in the ROM. The estimated intake air flow-rate is preferably defined by the map data based on the operating state of the internal combustion engine 50. According to the seventh embodiment of the invention, the estimated intake air flow-rate is defined by the map data based on the engine speed and the load. Alternatively, instead of the estimated intake air flow-rate, the response correction control amount eqeject may be directly stored in the ROM. In this case, the response correction control amount eqeject is calculated by reading the response correction control amount eqeject from the ROM based on the operating state of the internal combustion engine 50. According to the seventh embodiment of the invention, various control devices, detection devices and determination devices are implemented by the CPU, the ROM, and the RAM (hereinafter, collectively referred to as the CPU, etc.) and the various programs described above. A response correction control amount calculation device is implemented by the CPU, etc., and the response correction control amount calculation program. According to the seventh embodiment of the invention, an ejector system 100 is implemented by the vacuum switching valve 1G, the ejector 30 and the ECU 40G.

Next, the routine executed by the ECU 40G to calculate and change the response correction control amount eqeject when the vacuum switching valve 1G is opened will be described in detail with reference to the flowchart shown in FIG. 11. The CPU periodically executes the routine shown by the flowchart at considerably short intervals based on the calculation program, etc. stored in the ROM, whereby the ECU 40G calculates and changes the response correction control amount eqeject. The CPU determines whether the vacuum switching valve 1G is opened (step S71). The CPU checks the status of the internal processing based on the program used to control the vacuum switching valve 1G, which is executed by the ECU 40C, whereby whether the vacuum switching valve 1G is opened is determined. Alternatively, when the vacuum switching valve 1G is provided with, for example, a limit switch that detects the operating state of the vacuum switching valve 1; whether the vacuum switching valve 1G is opened may be determined based on the signal output from the limit switch.

If an affirmative determination is made, the CPU detects the engine speed Ne based on the signal output from the crank angle sensor, detects the load based on the signal output from the encoder, and calculates the response correction control amount eqeject based on the detected engine speed Ne and load (step S72). A gradual increase in the intake air flow-rate, which is caused when the vacuum switching valve 1G is opened, is regarded as an instantaneous increase by using response correction control amount eqeject calculated in the step 72 in the control executed on the electric throttle valve system 13. Next, the CPU changes the response correction control amount eqeject (step S73). More specifically, according to the seventh embodiment of the invention, a new response correction control amount eqejectT is calculated by decreasing the current response correction control amount eqeject by the equation shown in step S73, and the response correction control amount eqeject is updated to the new response correction control amount eqejectT, whereby the response correction control amount eqeject is changed. Alternatively, the response correction control amount eqeject may be changed by another equation, using the map data, etc. Next, the CPU determines whether the response correction control amount eqeject is zero (step S74). If a negative determination is made in step S74, the CPU executes step S73 again. Namely, the response correction control amount eqeject is gradually decreased by periodically executing steps 73 and 74 until the response correction control amount equject becomes zero. Even if the flow-rate of the intake air that actually flows through the bypass passage B gradually increases after the vacuum switching valve 1G is opened, a gradual increase in the intake air flow-rate is continuously regarded as an instantaneous increase by using response correction control amount eqeject calculated in step S73 in the control executed on the electric throttle valve system 13. On the other hand, if a negative determination is made in step S71, the CPU periodically executes step S71. If an affirmative determination is made in step S74, step S71 is executed again.

Figure 11:
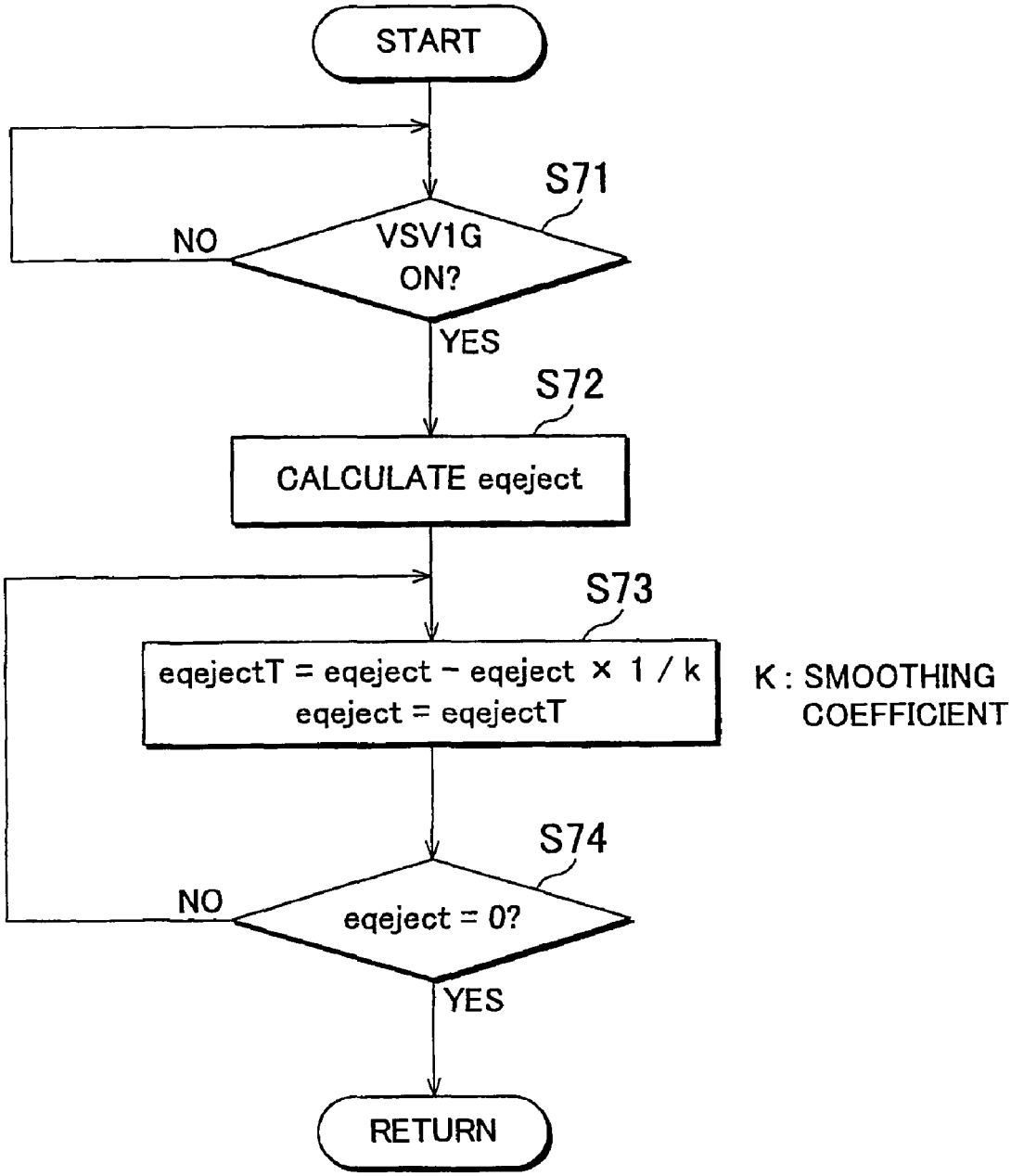
FIG. 11 is the flowchart showing the routine executed by an ECU 40G according to a seventh embodiment of the invention.
Figure 12:
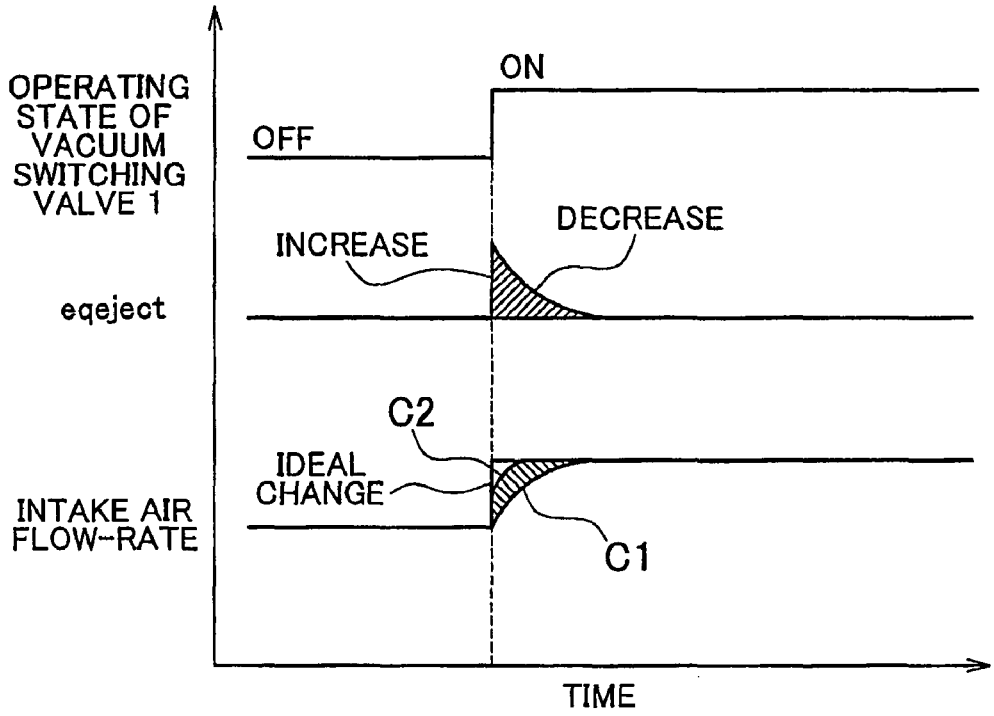
FIG. 12 is the time chart schematically showing changes in the operating state of a vacuum switching valve 1G, the response correction control amount eqeject and the intake air flow-rate, the time chart corresponding to the flowchart shown in FIG. 11.
Figure 13:
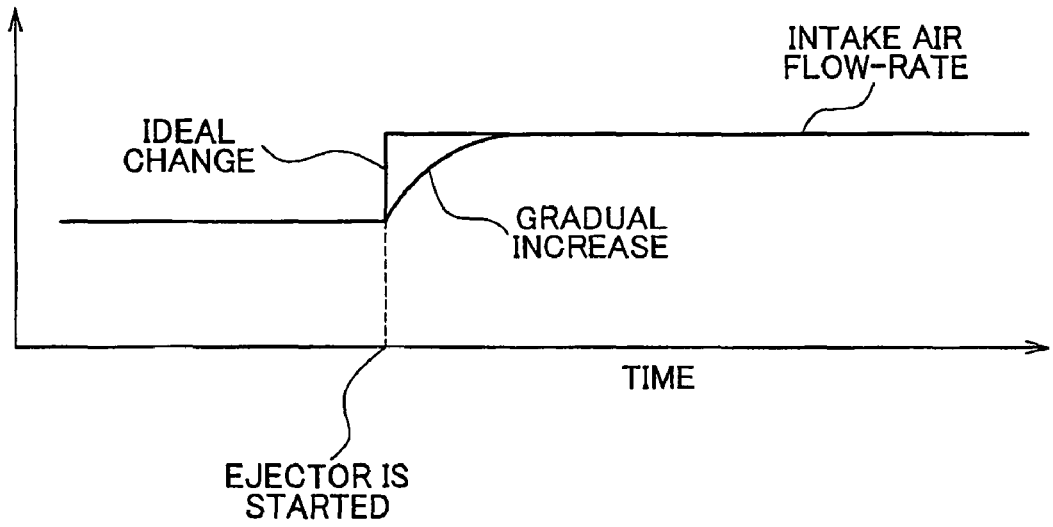
FIG. 13 is the time chart schematically showing a change that occurs in the flow-rate of the intake air flowing through a bypass passage when the ejector is caused to operate.

FIG. 12 is the time-chart that schematically shows changes in the operating state of the vacuum switching valve 1G, the response correction control amount eqeject and the intake air flow-rate, and that corresponds to the flowchart shown in FIG. 11. The curve C1 shows a change in the flow-rate of the intake air that flows through the bypass passage B. When the vacuum switching valve 1G is opened, the response correction control amount eqeject is calculated in step S72, whereby the response correction control amount eqeject is increased.

Then, the response correction control amount eqeject is gradually decreased by periodically changing the response correction control amount eqeject in steps S73 and S74. The response correction control amount eqeject is used in the control executed on the electric throttle valve system 13, whereby the intake air flow-rate changes as shown by the curve C2. Thus, a gradual increase in the intake air flow-rate, which is caused when the vacuum switching valve 1G is opened, is regarded as an instantaneous increase. Accordingly, it becomes easier to execute the idle-speed control at an appropriate time using, for example, the ejector 30 as the target of the correction control included in the idle-speed control. As a result, fluctuations in the idle speed are more appropriately suppressed. For example, even if the vacuum switching valve 1G is opened when the vehicle is accelerating, an increase in the intake air flow-rate is regarded as an instantaneous increase. Accordingly, it becomes easier to correct the fuel injection amount at an appropriate time, which makes it possible to control the air-fuel ratio appropriately. With the configuration described above, it is possible to implement the ECU 40G that enables appropriate execution of the idle-speed control, the air-fuel ratio control, etc. by correcting the delayed response of the intake air flow-rate that gradually increases when the ejector 30 is caused to operate.

Next an eighth embodiment of the invention will be described. The idle-speed control program includes the idle-speed control required amount calculation program and the electric throttle valve system control program used to control the electric throttle valve system 13 based on the final idle-speed control required amount eqcal. When a vacuum switching valve 1H is controlled so that the ejector is caused to operate (hereinafter, simply referred to as "the vacuum switching valve 1H is opened"), the idle-speed control required amount eqcal is calculated by subtracting the control amount eqeject that corresponds to an increase in the intake air flow-rate, which is caused when the vacuum switching valve 1H is opened from the normal idle-speed control amount eqcalb, according to the idle-speed control required amount calculation program. On the other hand, when the vacuum switching valve 1H is controlled to cause the ejector 30 to stop operating hereinafter, simply referred to as "the vacuum switching valve 1H is closed"), the idle-speed control required amount eqcal is made to coincide with the normal time idle-speed control amount eqcalb according to the idle-speed control required amount calculation program. According to the eighth embodiment of the invention, the normal time idle-speed control amount eqcalb includes the various control amounts described below.

The normal time idle-speed control amount eqcalb includes the control amounts eqg, eqi, eqdlnt, eqsta, eqthw, eqac, eqels, eqcat, eqdln, eqaenst, eqps, eqnd, eqpg, eqvtf, and eqaddmax. Each of these control amounts included in the normal time idle-speed control amount eqcalb may be a negative value. These control amounts are calculated according to the idle-speed control required amount calculation program, and the normal time idle-speed control amount eqcalb is calculated as the sum of these control amounts according to the idle-speed control required amount calculation program. The control amount eqg is used in the learning control executed on the electric throttle valve system 13. The control amount eqi is used in the feedback control executed on the electric throttle valve system 13. The control amount eqdlnt is set in accordance with the target engine speed. The control amount eqsta is used to increase the engine speed Ne when the internal combustion engine 50 is started. The control amount eqthw is set in accordance with the temperature of the coolant. The control amount eqac is set in accordance with the load placed on the air-conditioner compressor 55. The control amount eqels is set in accordance with the load placed on the generator. The control amount eqcat is used to increase the intake air flow-rate under the catalyst warning control. The control amount eqdln is used to increase the intake air flow-rate if the engine speed Ne decreases due to disturbance, etc. The control amount eqaenst is used to prevent engine stalling.

The control amount eqps is set in accordance with the load of a power steering pump. The control amount eqnd is set in accordance with the load of the transmission (not shown) in the driving or non-driving range. The control amount eqpg is used to execute correction based on the amount of purged evaporated-fuel. The control amount eqvtf is used to execute correction when the variable valve timing mechanism (not shown) malfunctions and therefore the valve timing is advanced. The control amount eqaddmax is set in accordance with the maximum value of the final reference flow-rate. The maximum value among the dash pot correction amount eqdp, the deceleration-time idle-up correction amount eqdwn, and the running-time correction amount eqcrs is selected as the control amount eqaddmax. Among the control amounts described above, the control amounts eqdlnt, eqsta, eqthw, eqac, eqels, eqcat, eqvtf, eqaddmax need not be responsive to a change in the intake air flow-rate. According to the eighth embodiment of the invention, the sum of these control amounts is calculated, as a predetermined control amount eqejeb that need not be responsive to a change in the intake air flow-rate, according to the idle-speed control amount calculation program.

According to the eighth embodiment of the invention, the program used to control the vacuum switching valve 1H includes the program used to open the vacuum switching valve 1H when the control amount eqejeb is greater than the control amount eqeject. The control amount eqejeb signifies the intake air flow-rate that is required by the internal combustion engine 50. The control amount eqeject signifies the intake air flow-rate that is increased when the vacuum switching valve 1H is opened. According to the eighth embodiment of the invention, the various control devices, the detection devices and the determination devices are implemented by the CPU, the ROM, the RAM hereinafter, simply referred to as the CPU, etc.), and the various programs. Especially, a priority control device is implemented by the CPU, etc. and the program used to control the vacuum switching valve 1H. According to the eighth embodiment of the injection, a negative pressure generator 100H is implemented by the vacuum switching valve 1H and the ejector 30.

Figure 14:
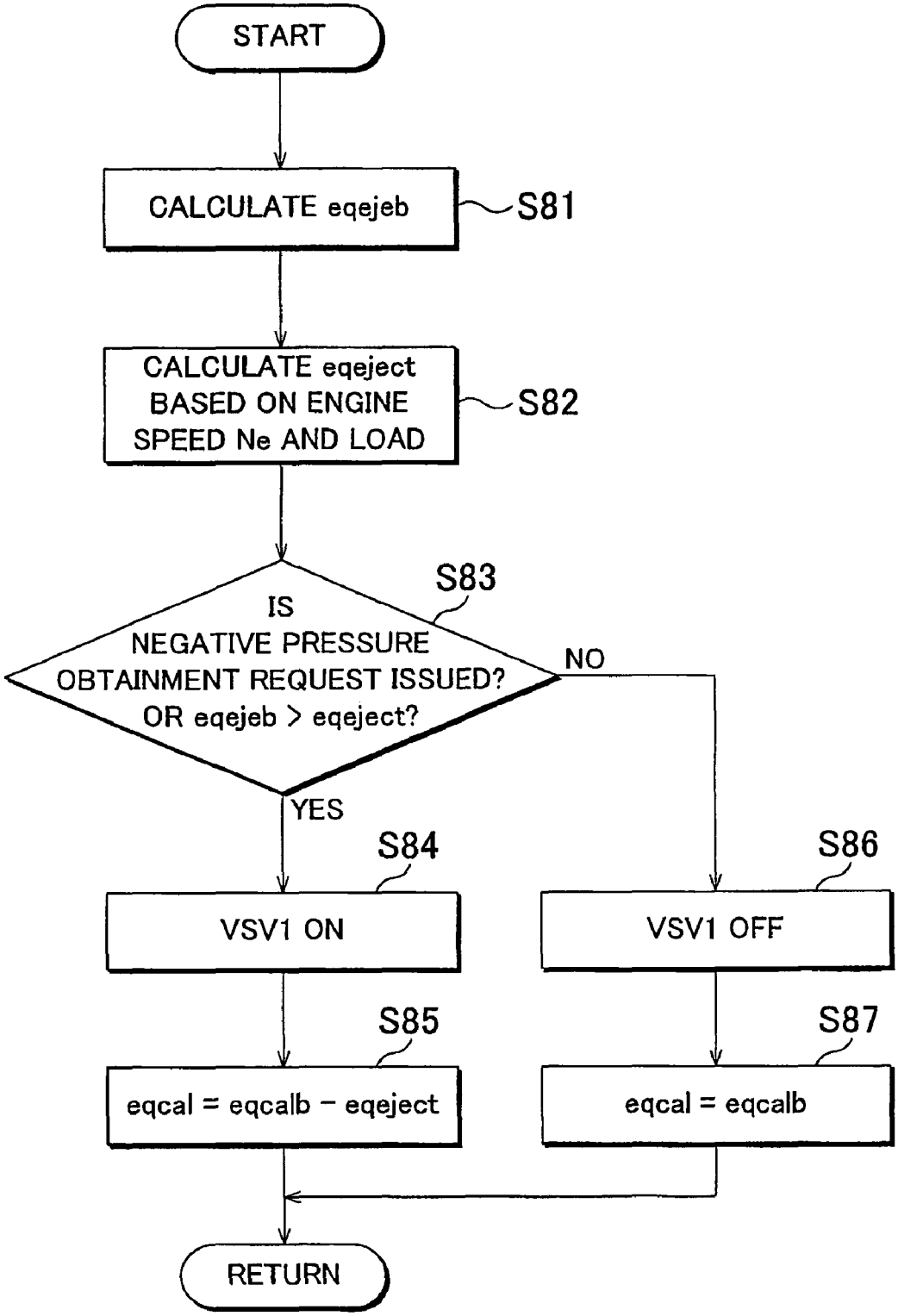
FIG. 14 is the flowchart showing the routine executed by an ECU 40H according to an eighth embodiment of the invention.
Figure 15:
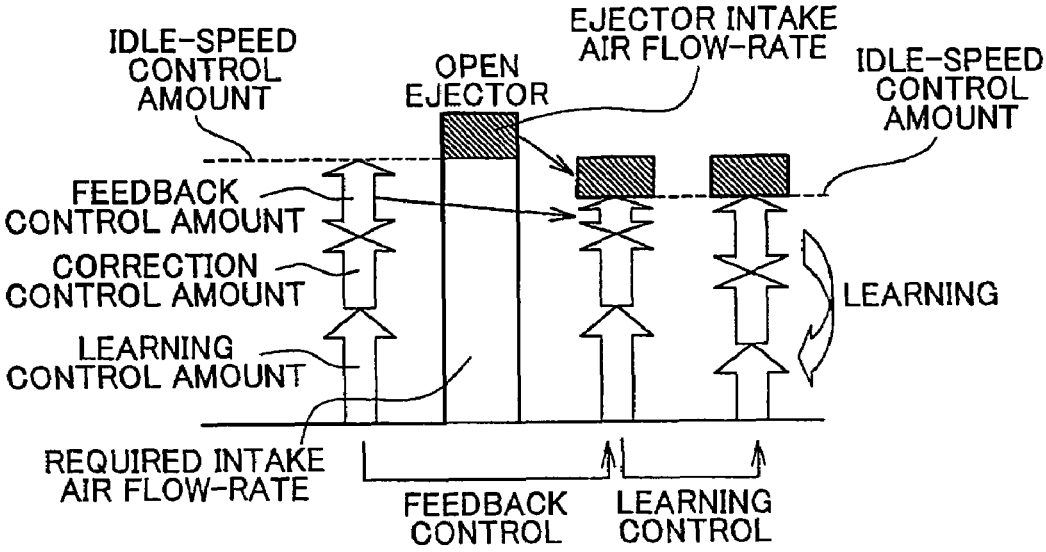
FIG. 15 PRIOR ART
FIG. 15 is the view conceptually showing the common idle-speed control.
Figure 16:
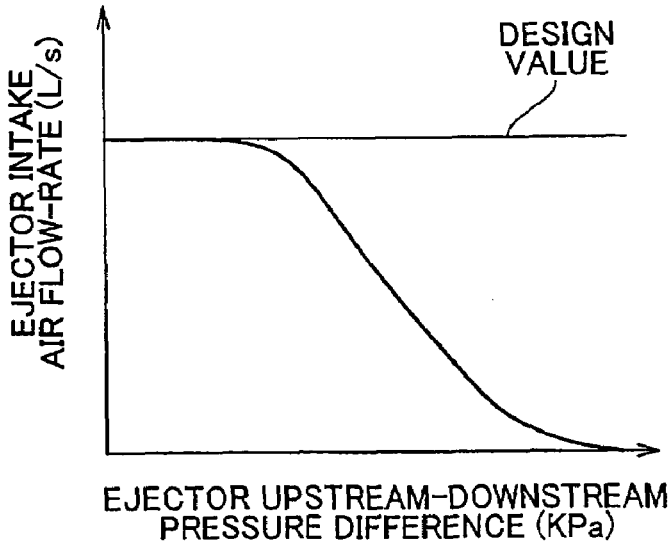
FIG. 16 is the graph showing the correlation between the flow-rate of the intake air flowing through the ejector and the pressure difference between the upstream side and the downstream side of the ejector.

Next, the routine executed by an ECU 40H to control the vacuum switching valve 1H will be described in detail with reference to the flowchart shown in FIG. 14. The CPU periodically executes the routine shown in the flowchart at considerably short intervals based on the program used to control the vacuum switching valve 1H, the idle-speed control required amount calculation program, etc. stored in the ROM, whereby the ECU 40H controls the negative pressure generator 100H. The PCU calculates the control amount eqejeb (step S81). Next, the CPU detects the engine speed Ne based on the signal output from the crank angle sensor, detects the load based on the signal output from the encoder, and calculates the control amount eqeject based on the detected engine speed Ne and load (step S82). According to the eighth embodiment of the invention, the map data that indicates the estimated intake air flow-rate defined based on the engine speed Ne and the load is stored in the ROM. The control amount eqeject is calculated based on the estimated intake air flow-rate. The estimated intake air flow-rate is an estimated value of the intake air flow-rate that increases when the vacuum switching valve 1H is opened, and set in advance based on the results of measurements such as a bench test. Alternatively, the control amount eqeject may be directly stored in the ROM instead of the estimated intake air flow-rate.

Next, the CPU determines whether a negative pressure obtainment request is issued or whether the control amount eqejeb is greater than the control amount eqeject (step S83). Namely, whether a negative pressure obtainment request is issued, whether the idle speed is maintained even if the ejector 30 is caused to operate, and whether it is possible to appropriately control the idle speed are determined in step S83. A negative pressure obtainment request is issued, for example, when the negative pressure in the negative pressure chamber of the brake booster 22 does not satisfy the reference value or pumping brake is applied. Even when a negative pressure obtainment request is not issued, if an affirmative determination is made in step S83, the CPU opens the vacuum switching valve 1H (step S84). Thus, the ejector 30 is operated more frequently. If the vacuum switching valve 1H has been open, step S84 may be skipped. Next, the CPU calculates the control amount eqcal by subtracting the control amount eqeject from the control amount eqcalb (step S85). The electric throttle valve system 13 is controlled based on the control amount eqcal calculated in step S85. Namely, according to the eighth embodiment of the invention, the electric throttle valve system 13 is controlled based on the control amount eqcal calculated in step S85, after the vacuum switching valve 1H is opened in step S84. Thus, the vacuum switching valve 1H is opened before opening the throttle valve 13*a* of the electric throttle valve system 13.

If a negative determination is made in step S83, the CPU closes the vacuum switching valve 1H (step S86), and makes the control amount eqcalb coincide with the control amount eqcal (step S87). Thus, it is possible to avoid the situation in which the maintenance of the idle speed is affected or control of the idle speed becomes inappropriate due to the operation of the ejector 30. In this case, the vacuum switching valve 1H does not contribute to adjustment of the intake air flow-rate and the intake air flow-rate is adjusted only by the electric throttle valve system 13. Namely, if a negative determination is made in step S83, a higher priority is given to the control of the electric throttle valve system 13 than the control of the vacuum switching valve 1H. If it is determined in step S83 that a negative pressure obtainment request is issued, the vacuum switching valve 1H is opened in step S83 regardless of whether the control amount eqejeb is greater than the control amount eqeject. Thus, the ejector 30 is appropriately caused to operate as needed in the viewpoint of improvement in the safety such as obtainment of sufficient brake performance. With the configuration described above, it is possible to implement the ECU 40H that gives a priority to the obtainment of a negative pressure using the ejector 30 and that minimizes the inconvenience caused by a delay in response to a change in the intake air flow-rate during the transitional period when a negative pressure is obtained by causing the ejector 30 to operate more frequently.

While the invention has been described with reference to example embodiments thereof, it is to be understood that the invention is not limited to the example embodiments. To the contrary, the invention is intended to cover various modifications and equivalent arrangements within the scope of the invention.

What is claimed is:

1. An ejector system for a vehicle, comprising:

an idling-timing flow-rate adjustment device that adjusts an intake air flow-rate that is a flow-rate of an intake air to be supplied to an internal combustion engine when the internal combustion engine is idling;

an ejector that generates a negative pressure of which an absolute value is larger than an absolute value of a negative pressure to be introduced from an intake passage of an intake system of the internal combustion engine;

a state changing device that causes the ejector to operate or causes the ejector to stop operating; and a control unit that controls the state changing device, and that controls the idling-timing flow-rate adjustment device based on an operating state of the ejector, wherein a flow rate of an intake air that flows through the ejector increases more moderately than a flow rate of an intake air that flows through the idling-timing flow-rate adjustment device, and when the intake air flow-rate is adjusted to an intake air flow-rate required by the internal combustion engine while the internal combustion engine is idling, the control unit determines whether it is possible to maintain an idle speed or control the idle speed appropriately even if the state changing device is caused to operate by determining whether an intake air flow-rate that is indicated by a predetermined control amount which need not be responsive to a change in the intake air flow-rate, from among control amounts used to control the idling-timing flow-rate adjustment device, is higher than the intake air flow-rate that increases when the ejector is caused to operate, and when the control unit determines that the intake air flow-rate that is indicated by the control amount which need not be responsive to the change in the intake air flow-rate, from among the control amounts for the internal combustion engine, is higher than the intake air flow-rate that increases when the ejector is caused to operate, the control unit causes the state changing device to operate before adjustment by the idling-timing flow-rate adjustment device is made.

2. The ejector system for a vehicle according to claim 1, wherein the control unit further includes an idle-speed control amount correction device that corrects an idle-speed control amount used in idle-speed control executed on the idling-timing flow-rate adjustment device by an ejector correction amount appropriate for the intake air flow-rate that increases or decreases in accordance with an operating state of the state changing device.

3. The ejector system for a vehicle according to claim 2, wherein the control unit further includes a specific control amount learning device that learns a control amount used to control the idling timing flow-rate adjustment device so that, when the intake air flow-rate deviates from a target intake air flow-rate by an amount equal to or greater than a predetermined value due to a change in the operating state of the state changing device, if a new change is caused in the operating state of the state changing device, the intake air flow-rate is maintained at the target intake air flow-rate or the intake air flow-rate falls within an allowable fluctuation range with respect to the target intake air flow-rate.

4. The ejector system for a vehicle according to claim 2, wherein the control unit further includes an ejector correction amount changing device that changes the ejector correction amount in accordance with a difference between a pressure on a side of an inlet port of the ejector and a pressure on a side of an outlet port of the ejector.

5. The ejector system for a vehicle according to claim 1, wherein the control unit further includes a control amount learning device that learns a learning control amount used in learning control executed on the idling timing flow-rate adjustment device so that the intake air flow-rate is maintained at a target intake air flow-rate; and a control amount learning prohibition device that prohibits execution of learning when the ejector is operating.

6. The ejector system for a vehicle according to claim 1, wherein the control unit further includes a feedback control device that controls the idling timing flow-rate adjustment device in a feedback manner so that fluctuations in the intake air flow-rate are suppressed; and a control speed changing device that increases a control speed at which the feedback control device controls the idling timing flow-rate adjustment device in a feedback manner, in accordance with a change in an operating state of the state changing device.

7. The ejector system for a vehicle according to claim 1, wherein the state changing device is structured to variably control a flow passage area of a passage, and the control unit further includes a gradual change control device that gradually controls the state changing device so that the flow passage area of the passage is gradually increased or decreased at a predetermined rate.

8. The ejector system for a vehicle according to claim 1, wherein the control unit further includes a response correction control amount calculation device that calculates a response correction control amount used to control the idling timing flow-rate adjustment device so that the intake air flow-rate increases when the state changing device is controlled to cause the ejector to operate.

9. The ejector system for a vehicle according to claim 8, wherein the response correction control amount calculation device changes the response correction control amount so that the intake air flow-rate gradually decreases.

10. The ejector system for a vehicle according to claim 1, wherein the intake air flow-rate required by the internal combustion engine is an intake air flow-rate that is indicated by a predetermined control amount which need not be responsive to a change in the intake air flow-rate, from among control amounts used to control the idling-timing flow-rate adjustment device.

* * * * *